US011530550B2

(12) United States Patent
Nead

(10) Patent No.: US 11,530,550 B2
(45) Date of Patent: Dec. 20, 2022

(54) ERECTING FRAME AND PROTECTIVE SKIN SHELTER SYSTEM

(71) Applicant: Daniel M. Nead, Johnson City, NY (US)

(72) Inventor: Daniel M. Nead, Johnson City, NY (US)

( * ) Notice: Subject to any disclaimer, the term of this patent is extended or adjusted under 35 U.S.C. 154(b) by 0 days.

(21) Appl. No.: 16/591,805

(22) Filed: Oct. 3, 2019

(65) Prior Publication Data

US 2021/0102398 A1 Apr. 8, 2021

(51) Int. Cl.

| | |
|---|---|
| ***E04H 15/48*** | (2006.01) |
| ***E04H 9/04*** | (2006.01) |
| ***E04B 1/00*** | (2006.01) |
| ***F41H 5/24*** | (2006.01) |
| ***E04H 15/00*** | (2006.01) |

(Continued)

(52) U.S. Cl.

CPC ..... *E04H 15/48* (2013.01); *E04B 1/3533* (2013.01); *E04B 7/24* (2013.01); *E04H 9/04* (2013.01); *E04H 9/10* (2013.01); *E04H 15/008* (2013.01); *E04H 15/34* (2013.01); *E04H 15/38* (2013.01);

(Continued)

(58) Field of Classification Search

CPC ..... E04H 15/48; E04H 15/34; E04H 15/38; E04H 15/008; E04H 9/04; E04H 9/10; E04B 7/24; E04B 1/3533; E04B 2001/0069; F41H 5/24

USPC ..... 52/71, 91.1, 93, 168, 169.6; 135/123, 135/124, 128, 901; 89/36.04, 36.07, 89/36.09

See application file for complete search history.

(56) References Cited

U.S. PATENT DOCUMENTS 712,605 A 11/1902 Shaaber
1,177,949 A * 4/1916 Homme ..... E04H 15/18 135/123

(Continued)

FOREIGN PATENT DOCUMENTS

DE 3931895 A1 12/1994
NL 9101816 A * 5/1993

*Primary Examiner* — Robert Canfield

(74) *Attorney, Agent, or Firm* — Brown & Michaels, PC

(57) ABSTRACT

A shelter system having an erecting frame system and a protective skin system. The erecting frame system has at least two A-frame legs and at least one tensioning element. The A-frame legs each comprise at least one elongated structural member, each of the A-frame legs coalescing with at least one other A-frame leg with at least one connection. The tensioning element is at least temporarily affixed to a free end of each of the at least two A-frame legs, and comprises at least one elongated structural element capable of generating a tension force to draw the free ends of the A-frame legs towards one another, thereby at least temporarily lifting the connection to a predetermined height above the free end of each A-frame leg. A protective skin system is also provided with at least one side plane, one roof plane, and one end plane. The side plane is disposed between two A-frame legs; the roof plane is concordant with the ground surface; and the end plane is disposed between two A-frame legs of a constituent A-frame leg pair and a ground surface. The planar element of the protective skin system provides at least a partial barrier from a ballistic threat to a volume behind the planar element, the loading of the protective skin system being transferred at least in part first to the erecting frame system and ultimately to the ground surface.

20 Claims, 18 Drawing Sheets

(51) Int. Cl.

| | |
|---|---|
| ***E04B 7/24*** | (2006.01) |
| ***E04H 15/34*** | (2006.01) |
| ***E04H 15/38*** | (2006.01) |
| ***E04B 1/35*** | (2006.01) |
| ***E04H 9/10*** | (2006.01) |

(52) U.S. Cl.
CPC ..... *F41H 5/24* (2013.01); *E04B 2001/0069* (2013.01)

(56) References Cited

U.S. PATENT DOCUMENTS 1,709,568 A * 4/1929 Frank ..... E04H 15/48 135/123
2,960,993 A 11/1960 Carl
3,193,973 A * 7/1965 Reuscher ..... E04B 1/3533 52/745.14
3,385,013 A * 5/1968 Severson ..... E04B 1/26 52/91.3
3,474,804 A * 10/1969 Charlotte ..... E04H 15/003 135/98
3,720,033 A * 3/1973 Van Burleigh ..... E04B 7/24 52/745.06
3,798,851 A * 3/1974 Utahara ..... E04B 1/3205 52/86
3,807,104 A * 4/1974 Webster ..... E04B 1/3445 52/70
3,849,953 A * 11/1974 Cohen ..... E04C 3/38 52/86
3,906,968 A 9/1975 Black
4,576,116 A 3/1986 Binkert
4,595,203 A 6/1986 DeLano et al.
4,857,119 A 8/1989 Karst et al.
4,926,591 A * 5/1990 Buijs ..... E04B 1/3447 52/122.1
5,381,634 A * 1/1995 Pietrogrande ..... A01F 25/13 135/138
5,595,203 A 1/1997 Espinosa
5,609,177 A 3/1997 Iver
6,631,590 B1 10/2003 Glowaski
6,883,331 B2 4/2005 Jönsson et al.
7,077,306 B2 7/2006 Palicka et al.
7,866,106 B2 1/2011 Bowlware
8,371,322 B1 2/2013 Wilson-Campbell
9,279,265 B1 * 3/2016 Nead ..... E04H 9/10
2012/0073428 A1 * 3/2012 Milinkovic ..... E04G 21/16 89/36.04
2012/0090455 A1 * 4/2012 Duncan ..... E04H 15/18 89/36.07
2012/0174763 A1 * 7/2012 Ritchie ..... F41H 5/06 89/36.04
2016/0010247 A1 1/2016 De Backer
2016/0047630 A1 * 2/2016 Nead ..... F41H 5/013 89/36.02
2016/0103474 A1 4/2016 Kumar et al.
2019/0234094 A1 * 8/2019 Nead ..... E04H 9/10

* cited by examiner

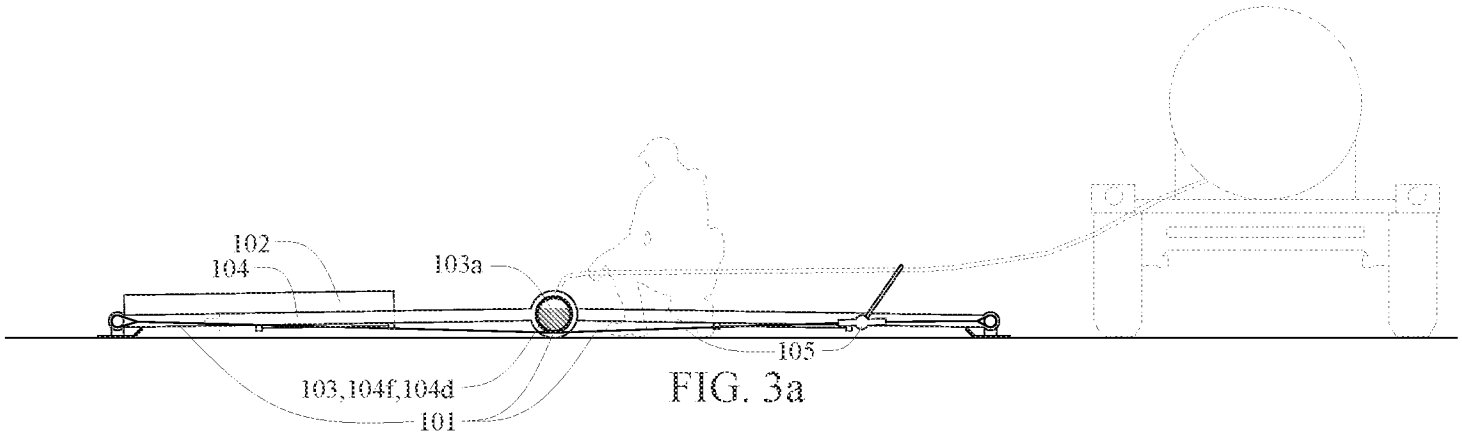
FIG. 3a
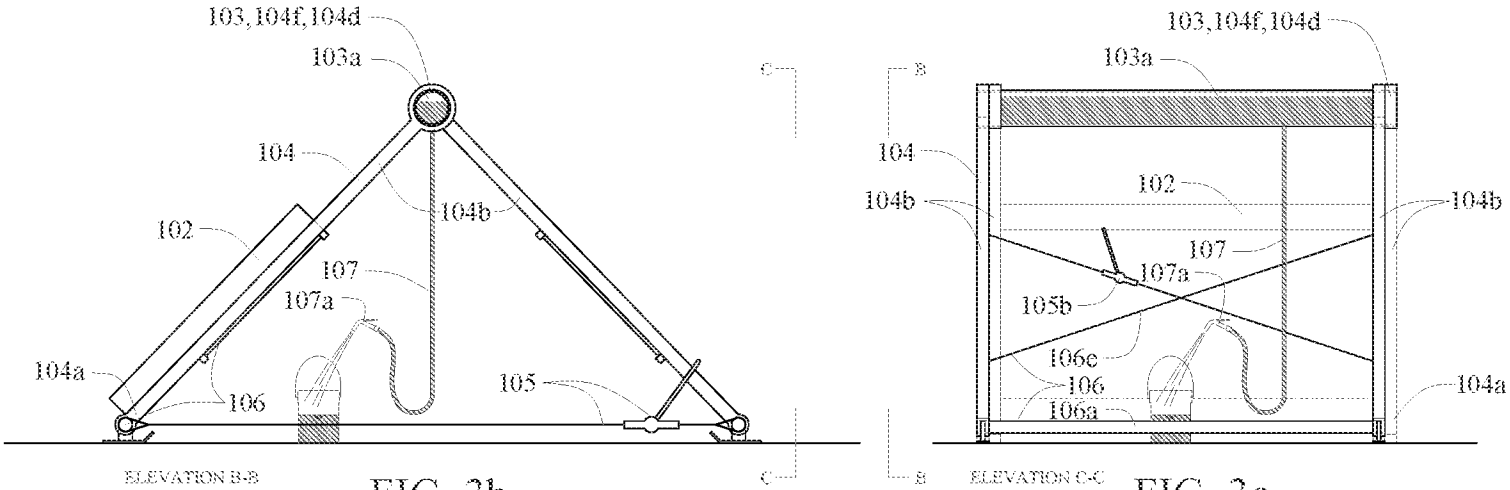
FIG. 3b
FIG. 3c

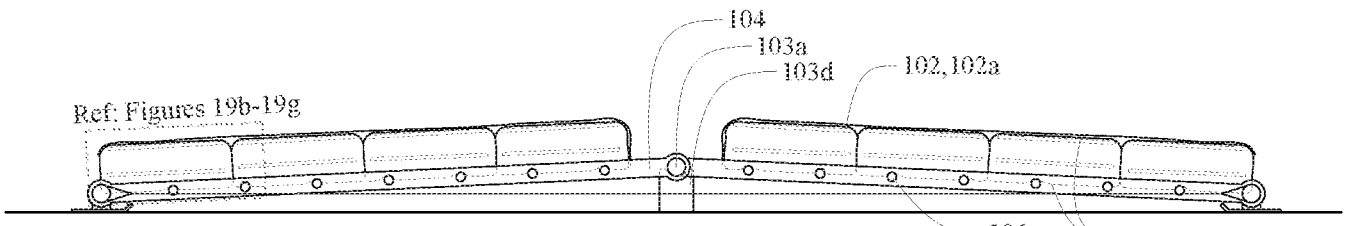
FIG. 19a
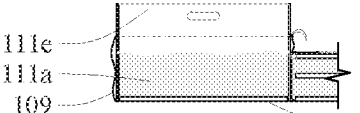
FIG. 19b
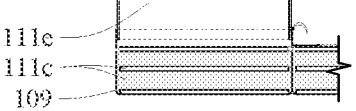
FIG. 19d
FIG. 19f
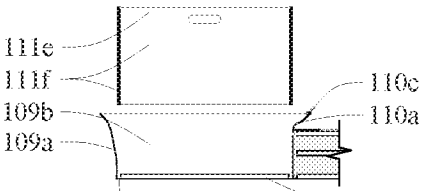
FIG. 19c
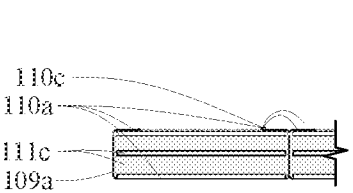
FIG. 19e
FIG. 19g

ERECTING FRAME AND PROTECTIVE SKIN SHELTER SYSTEM

RELATED PATENT APPLICATION

The present application is a continuation-in-part application of patent application Ser. No. 15/881,743 for ERECTING FRAME AND PROTECTIVE SKIN SHELTER SYSTEM, filed Jan. 27, 2018, which was a continuation-in-part application of Ser. No. 14/749,974, for VESSEL AND INSERT ARMOR SYSTEM, filed Jun. 25, 2015, and hereby incorporates the teaching of both applications by reference.

FIELD OF THE INVENTION

This invention is directed at an erecting frame and protective skin system that provides for rapid establishment of a shelter, the protective skin system including a vessel-based armor embodiment.

BACKGROUND OF THE INVENTION

In combat and related scenarios, there is a basic demand for protective shelter systems capable of mitigating ballistic threats. The time and equipment required to establish the shelter system, the production and transportation cost of providing and deploying the shelter, and the level of protection provided during deployment of the shelter are three primary metrics that determine the efficacy of a shelter system.

The time and equipment required to establish the shelter system influences what type of role a protective shelter system can provide. In general, contemporary protective shelter practices are often restricted to long term static roles because of inefficiencies presented in their transport and in their assembly. A general over-reliance on heavy equipment during the assembly and transport stages often results in either subpar levels of protection or the employment of tedious practices in the assembly of the protective shelter. There is often a general disconnect between the most efficient position of the shelter protective element(s) during the assembly stage and in the most effective position of the shelter protective element(s) when serving their protective role. This is especially the case when the protective element (s) are numerous, heavy, or require a process for assembly themselves.

Additionally, contemporary shelter practices are often ad-hoc assemblies of conglomerate systems and materials. These practices may be modular at the component level but are not often modular at the system level. A shelter system that is standardized, modular, has minimal reliance on heavy equipment, and relatively quick to establish would provide advantages over contemporary shelter practices.

The cost of production and delivery of a shelter system will determine how widespread its use will be. Similarly, a shelter system's level of protection from ballistic threats has obvious ramifications in determining the value of a shelter. Contemporary ballistic protection practices often favor collateral damage control over small group or individual protection as a consequence of the high cost of delivering effective protection at the small group or individual level. A shelter system that reduces the relative cost of protection will have obvious advantages over contemporary shelter practices.

DESCRIPTION OF RELATED ART

U.S. Pat. No. 4,857,119 issued to Karst, et al. for CASE-HARDENED PLATE ARMOR AND METHOD OF MAKING, issued on Aug. 15, 1989, describes a case-hardened plate armor that includes a steel plate that is heat treated to provide carbonitride surfaces and a tough, ductile core, with the carbonitride surfaces having a toughness of at least 66, and preferably at least 67, on the Rockwell C scale to prevent surface penetration, and with the tough, ductile core being softer than the carbonitride surfaces to prevent brittle fracture. The steel plate may be made from either rolled homogenous armor which has a final core hardness in the range of 45 to 50 on the Rockwell C scale, or from high-hard armor which has a final core hardness in the range of 52 to 54 on the Rockwell C scale. The steel plate may be made with holes or may be imperforate depending upon weight requirements. The case-hardening of the steel plate is performed by heating in an atmosphere of nitrogen and carbon, quenching of the heated steel plate, thereafter tempering the quenched steel plate, deep freezing of the tempered steel plate, and subsequently again tempering the steel plate after the deep freezing to provide the hard carbonitride surfaces and the softer but tougher and more ductile core.

U.S. Pat. No. 6,883,331 issued to Perttu for TIP-UP TENT, issued on Apr. 26, 2005, describes a tip-up tent comprising a foldable tubular A-frame comprising four diagonal legs connected to a horizontal member, a hinged transparent flexible cover supported by the A-frame with each side of the cover having a lower flap with holes in each lower comer, and a plurality of arrow-shaped stakes, wherein the tip-up tent is held in place on ice by stakes driven into the ice through the holes or by snow piled up on the flaps. The tip-up tent has particular utility in connection with protecting an ice fishing tip-up from the wind and snow.

U.S. Pat. No. 5,595,203 issued to Espinosa for STRESSED ARCH STRUCTURES, issued on Jan. 21, 1997, describes a portable stressed arch structure constructed by assembling an essentially flat, planar frame of straight, uncurved components, and then drawing two opposite sides together and securing them with tension cables to hold the frame in an arch configuration. The arched framework is then covered with a conventional tarp or the like, as desired. The structure may be formed substantially of conventional polyvinyl chloride or other plastic pipe or tube, and may also utilize modified or specially formed connectors and other components. Supplementary bracing and other components may be added as desired or as needed, depending upon anticipated loads and size of the completed structure. Structures may be formed having relatively widely spaced arched ribs, or alternatively may be constructed having two or more adjacent ribs joined by common specialized connectors. The result is an easily assemblable and economical structure suitable for use as a shelter for boats, cars, and/or other relatively large objects, and/or for use as a garden or yard shed or the like, as desired.

Espinosa fails to disclose a "tensioning element," as provided in the inventive system described hereinbelow. Rather, the Espinosa member is in tension, as opposed to a "tensioning member" (i.e., capable of generating a tension force), which serves an active role in the erecting capability of the inventive erecting frame. The Espinosa tension member does not generate a force; rather, it reacts to one in a static manner. Applicant's tensioning element has dynamic potential, whereas a simple Espinosa member in tension serves a static role. Applicant's tensioning element's role of generating a tension force capable of drawing A-frame leg feet together, thereby lifting the protective skin system off of the ground is described in greater detail in the Detailed Description of the Preferred Embodiment, hereinbelow.

U.S. Pat. No. 7,866,106 issued to Bowlware for PORTABLE BALLISTICS BARRIER, issued on Jan. 1, 2011, describes a barrier comprising a body member having a first side, a second side, a front side, a rear side, and one or more cavities within the body member. The body member further has a first overlap portion and a second overlap portion. The first overlap portion extends from the first side adjacent to the front side and spaced apart from the rear side. The second overlap portion extends from the second side adjacent to the rear side and spaced apart from the second side. The second overlap portion is shaped to mate in an overlapping manner with the first overlap portion of an adjacent body member. A barrier wall comprising two or more barriers is also disclosed.

U.S. Pat. No. 7,077,306 issued to Palicka, et al. for CERAMIC ARMOR AND METHOD OF MAKING BY ENCAPSULATION IN A HOT PRESSED THREE LAYER METAL ASSEMBLY, issued on Jul. 16, 2006, describes a ceramic armor in several embodiments. In a first embodiment, a metal base plate has a metal frame assembled on it having a central opening into which the ceramic material is placed. A cover plate is placed over the frame to enclose the ceramic material on all sides. In a second embodiment, the frame has an open central area that has two crossing walls that define four sub-chambers. Four pieces of ceramic material are placed in the respective sub-chambers and a covering plate is placed over it. In a further embodiment, the frame has a plurality of cavities mechanically formed in it. A ceramic tile or plate is placed in each cavity and a cover plate is placed over the frame. The metal used to encapsulate the ceramic material may, if desired, comprise a Titanium alloy such as Ti-6Al-4V, and the ceramic material may comprise silicon carbide, boron carbide, tungsten carbide, titanium diboride or aluminum nitride. A hot pressing procedure is carried out on the armor to cause the metal to plastically deform about the encapsulated ceramic material.

U.S. Pat. No. 712,605 issued to Shaaber for ARMOR PLATE, issued on Nov. 4, 1902, describes an armor plate of the composite type, preferably cast-steel and formed with chamber-recesses in its outer face, each adapted to receive a series of springs and a piston-plate loosely fitting the recess and serving as a follower plate to distribute the force of a striking projectile. The armor plate is arranged to provide a yielding resistance to the projectile and at the same time deflect it from its course and so impair its penetrating power. The main or base plate therefore includes springs located in one of the chamber recesses formed in it, and small portions only of the piston-plate on the springs and of the cover plate.

German Patent No. 3931895 issued to Grunewald, et al., issued on Dec. 15, 1994, describes panel members adopted to support armor elements.

SUMMARY OF THE INVENTION

In accordance with the present invention, there is provided a shelter system having an erecting frame system and a protective skin system. The erecting frame system serves as a mount for the protective skin system and at least partially bears the loading of the protective skin system itself and any forces acting on the protective skin system. The protective skin system provides defensive protection from ballistic threats and protection from the natural elements.

The erecting frame system has at least two A-frame legs and at least one tensioning element. The A-frame legs each comprise at least one elongated structural member, each of the A-frame legs coalescing with at least one other A-frame leg with at least one connection. The tensioning element is at least temporarily affixed to a free end of each of the at least two A-frame legs, and comprises at least one elongated structural element capable of generating a tension force to draw the free ends of the A-frame legs towards one another, thereby at least temporarily lifting the connection to a predetermined height above the free end of each A-frame leg. A protective skin system is also provided with at least one side plane, one roof plane, and/or one end plane. The side plane is disposed between two A-frame legs; the roof plane is concordant with the ground surface; and the end plane is disposed between two A-frame legs of a constituent A-frame leg pair and a ground surface. The planar element of the protective skin system provides at least a partial barrier from a ballistic threat to a volume behind the planar element, the loading of the protective skin system being transferred at least in part first to the erecting frame system and ultimately to the ground surface.

There is often a general disconnect between the most efficient position of the shelter protective element(s) during the assembly stage and in the most effective position of the shelter protective element(s) when serving their protective role. This is especially the case when the protective element (s) are numerous, heavy, or require a process for assembly themselves. The dynamic nature of this invention's erecting frame system facilitates the assembly of this invention's protective skin system to occur when the erecting frame system is in a relatively flat arrangement near the ground surface.

Following the securing and assembly of the protective skin system to the erecting frame system, this frame system is erected into more or less an A-frame arrangement by drawing at least two leg components of the frame system together with a tension force, thereby lifting a central hinge or axle element that links at least two leg components together. This second arrangement is generally more effective in providing protection from ballistic threats as well as protection from the natural elements as an occupiable protected space is established behind and/or below the protective skin system.

This transition from a relatively flat arrangement during assembly to that of a relative A-frame arrangement increases the efficiency in the establishment of fill-based systems as well as more conventional armor panel or plate systems to be used in a protective skin role. In the case of particle fill based systems, the relatively flat arrangement during the assembly process also provides the opportunity to incorporate more advanced methods of assembly for particle fill based embodiments of the protective skin system compared to the fill-based practices that have been historically utilized.

One such advanced particle fill based assembly method for the protective skin system involves active compaction of particle fill within vessel elements; the filled vessel elements then compose the protective skin system. The compaction of the particle fill occurs when the frame system is in the relatively flat arrangement. Furthermore, the compacted particle fill procedure may be expanded upon to establish layered strata of compacted particle fill and internal plate(s). In a preferred embodiment, these plates serve a dual function of providing ballistic protection while also serving as a device to aid in the compaction of the particle fill during the assembly stage.

However, the protective skin system embodiments that are based on the use of vessel elements are not restricted to particle fill based methods in the provision of ballistic protection. Armored inserts options, including, but not restricted to spaced armor inserts, may be inserted into the vessel and utilized where access to fill or assembly time is particularly restricted. The vessel based option for the protective skin also allows for lighter travel, customization of protection, simple upgrades to the protection level, and the use of more conventional armor within the vessel elements should the particle fill based options be deemed unsuitable for the mission parameters. Moreover, the vessel element may be of rigid, semi-rigid, non-rigid, or some combination thereof.

The advantages of the erecting frame system may also be exploited by embodiments of the protective skin system that fall under the category of conventional non-vessel element based armor systems. These systems do not use the vessel element and internal ballistic protection element pairing; rather, the ballistic protection is provided by more or less conventional plate or panel surface. This surface may comprise multiple constituent plates or panels or it may be a single monolithic plate or panel. It should be noted that conventional non-vessel element based armor systems may make use of spaced armor arrangements. The utility of the relatively flat arrangement of the erecting frame system during the assembly process also facilitates a more efficient means of establishing more conventional plate or panel based embodiments of the protective skin system.

While one interpretation of protective skin might be that of at least one wall structure that attaches to the erecting frame and serves the role of at least partially shielding a volume therewithin (or behind), the erecting frame may also find use in establishing a protective roof structure to protect from high-trajectory threats. The ability to assemble a protective skin system in a position relatively close to the ground surface and then lift the protective roof structure and its associated planar element at the final stages of assembly is also a main role of this invention. In both cases, the utility of this transition of arrangement during the erecting phase of the assembly process is all the more obvious should the armored system be heavy in weight or comprise constituent elements that together are heavy in weight.

The erecting nature of the shelter system may serve other roles that increase the quality of life for those individuals utilizing the shelter. One such example is its utility in raising a container that has been filled with liquid while near the ground surface to a position that provides a pressure head due to its displacement above the ground surface after assembly; this provides useful access to pressurized water.

BRIEF DESCRIPTION OF THE DRAWINGS

A complete understanding of the present invention may be obtained by reference to the accompanying drawings, when considered in conjunction with the subsequent detailed description, in which:

FIG. 3*a* is an elevation view of an embodiment of the shelter system wherein the axle is capable of receiving liquid fill and the erecting frame system is substantially flat on the ground surface;

FIG. 3*b* is an elevation view of an embodiment of the shelter system wherein the axle is capable of containing and distributing liquid fill and the A-frame leg feet of the erecting frame system have been pulled towards one another by the tensioning element to create a pressure head relative to the ground surface for the liquid fill contained within the axle;

FIG. 3*c* is an elevation view of an embodiment of the shelter system wherein the axle is capable of containing and distributing liquid fill and the A-frame leg feet of the erecting frame system have been pulled towards one another by the tensioning element to create a pressure head relative to the ground surface for the liquid fill contained within the axle;

FIG. 19*a* is an elevation view of an erecting frame system embodiment with saddle embodiment in its flat arrangement, the protective skin system containing non-rigid vessel elements;

FIG. 19*b* is a diagrammatical section view of a compartment of a non-rigid vessel element based embodiment of the protective skin system and its associated filling process, a non-rigid vessel element is being slack;

FIG. 19*c* is a diagrammatical section view of a compartment of a non-rigid vessel element based embodiment of the protective skin system and its associated filling process, the compartment opening of the vessel element receiving a rigid form;

FIG. 19*d* is a diagrammatical section view of a compartment of a non-rigid vessel element based embodiment of the protective skin system and its associated filling process, the compartment having received particle fill and a compartment plate;

FIG. 19*e* is a diagrammatical section view of a compartment of a non-rigid vessel element based embodiment of the protective skin system and its associated filling process, a force is being applied to the compartment plate, compacting the particle fill below;

FIG. 19*f* is a diagrammatical section view of a compartment of a non-rigid vessel element based embodiment of the protective skin system and its associated filling process, establishing a strata and the rigid form being removed from the compartment;

FIG. 19*g* is a diagrammatical section view of a compartment of a non-rigid vessel element based embodiment of the protective skin system and its associated filling process, the drawstring of the top enclosure element being constricted around the perimeter of the top compartment plate to close the top opening of the compartment;

Like reference numerals refer to like parts throughout the several views of the drawings.

DETAILED DESCRIPTION OF THE PREFERRED EMBODIMENT

Figure 1A:
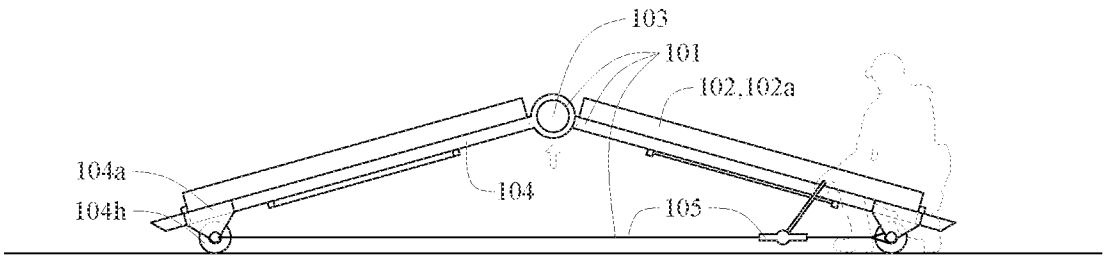
FIG. 1*a* is an elevation view of an embodiment of the shelter system wherein the A-frame leg feet of the erecting frame system have been pulled partially towards one another by the tensioning element; wheel components are attached at the free ends of the A-frame legs to assist in the erecting process.

Although the following detailed description contains specific details for the purposes of illustration, those of ordinary skill in the art will appreciate that variations and alterations to the following details are within the scope of the invention. Accordingly, the exemplary embodiments of the invention described below are set forth without any loss of generality to, and without imposing limitations upon, the claimed invention.

The following reference numerals refer to the corresponding elements in the figures.

| Reference numeral | Element |
|---|---|
| 101 | erecting frame system |
| 102 | protective skin systems |
| 102a | planar element |
| 102b | composition of adjacent masses |
| 102c | end protection planar element |
| 102d | roof protection planar element |
| 103 | hinge or pin type connection |
| 103a | axle |
| 103b | hinge element |
| 103c | central member |
| 103d | saddle |
| 104 | A-frame leg |
| 104a | A-frame leg foot |
| 104b | A-frame leg pair |
| 104c | thwart element |
| 104d | bearing element |
| 104e | track element |
| 104f | circular opening |
| 104g | Skid |
| 104h | Wheel |
| 104i | additional A-frame leg |
| 105 | tensioning element |
| 105a | cable |
| 105b | winch |
| 105c | rigid tension member |
| 106 | lateral bracing |
| 106a | rigid lateral member |
| 106b | footing member |
| 106c | lateral leg |
| 106d | gussets |
| 106e | bracing cable |
| 107 | hose |
| 107a | nozzle |
| 108 | protective roof structures |
| 108a | rafter element |
| 108b | purlin element |
| 108c | shaped roof bearing element |
| 109 | vessel element |

-continued

| Reference numeral | Element |
|---|---|
| 109a | sidewall |
| 109b | compartment |
| 109c | tethering element |
| 110 | containment system |
| 110a | enclosure element |
| 110b | flange |
| 110c | drawstring |
| 110d | additional enclosure element |
| 111 | internal ballistic protection elements |
| 111a | particle fill |
| 111b | compartment plate |
| 111c | strata |
| 111d | ballistic armor insert |
| 111e | rigid form |
| 111f | rigid sidewalls |
| 111g | spacing element |
| 111h | volume displacing element |
| 111i | spaced armor insert |
| 112a | armor plate |
| 112b | spaced armor assembly |
| 113 | floor surface |

The shelter system comprises an erecting frame system 101 and a protective skin system 102. A preferred embodiment of the shelter system is demonstrated in FIGS. 1*a*-1*b* and 3*a*-3*c*; an elemental embodiment of the shelter system is demonstrated in FIGS. 9*a*-9*b*. The erecting frame system 101 has at least two A-frame legs 104 and at least one tensioning element 105. The A-frame leg 104 serves the role of, and takes the form of, an elongated structural member; each of the A-frame legs 104 coalesces with at least one other A-frame leg 104 via at least one hinge or pin type connection 103. The tensioning element 105 is at least temporarily affixed to at least two free ends of the A-frame legs 104 and is capable of generating a tension force to draw the free ends of the A-frame legs 104 towards one another, thereby lifting the hinge or pin type connection 103 to a predetermined height above the free end of each A-frame leg 104. The protective skin system 102 has at least one planar element 102*a* that occupies at least one side plane, one roof plane, and/or one end plane of the erecting frame system 101. The planar element 102*a* of the protective skin system 102 provides at least a partial barrier from a ballistic threat to a volume behind said planar element 102*a*. The loading of and on the protective skin system 102 transfers at least in part first to the erecting frame system 101 and ultimately to the ground surface.

The Erecting Frame System

Figure 2A:
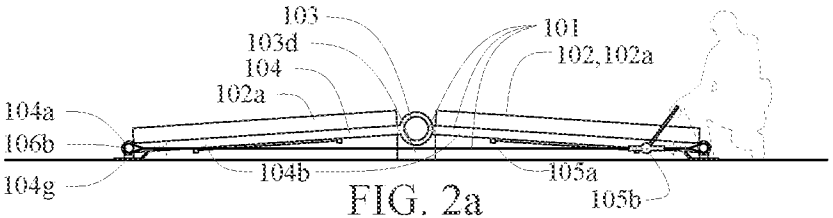
FIG. 2*a* is an elevation view of an embodiment of the shelter system wherein the erecting frame system is substantially flat on the ground surface; a saddle is present below the hinge or pin type connection and skid components are attached at the free ends of the A-frame legs to assist in the erecting process.
Figure 2B:
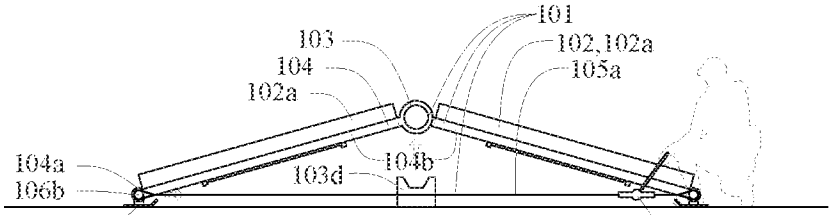
FIG. 2*b* is an elevation view of an embodiment of the shelter system wherein the A-frame leg feet of the erecting frame system have been pulled partially towards one another by the tensioning element.
Figure 2C:
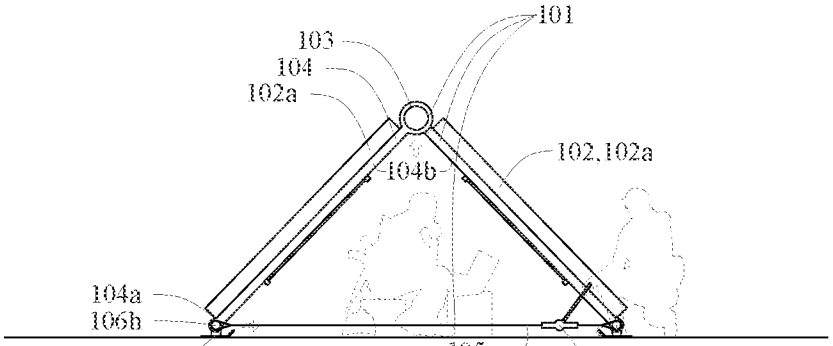
FIG. 2*c* is an elevation view of an embodiment of the shelter system wherein the A-frame leg feet of the erecting frame system have been pulled towards one another by the tensioning element to create an effective protected volume behind the protective skin system.

Referring now to FIG. 2*a*, there is shown an elevation view of an embodiment of the shelter system wherein the erecting frame system 101 is substantially flat on the ground surface. The erecting frame system 101 comprises at least one hinge or pin type connection 103, at least two A-frame legs 104, and at least one tensioning element 105. At least one A-frame leg 104 coalesces with at least one other A-frame leg 104 via a hinge or pin type connection 103. The tensioning element 105 affixes to each A-frame leg 104 proximate the free end of each A-frame leg 104 and provides a means of drawing the free ends of the paired A-frame legs 104 together via a tension force. The free end of the A-frame leg 104 may also be referred to as the A-frame leg foot 104*a* The intention of this arrangement is to facilitate the lifting of the hinge or pin type connection 103 to a greater height above the pairs of A-frame leg feet 104*a* as said A-frame leg feet 104*a* within an A-frame leg pair 104*b* are drawn together, as shown in FIG. 2*b*. In consequence, there is a transformation of the erecting frame system 101 from a structure that is relatively flat, as shown in FIG. 2*a*, to a structure that in form approximates an A-frame or other related volumetric from, as shown in FIG. 2*c*.

Axle and Bearing Embodiment(s)

Referring now to FIGS. 3*a*-3*c*, there are shown elevation views of an embodiment of the shelter system wherein the hinge or pin type connection 103 of the erecting frame system 101 further comprises an axle 103*a* and at least one bearing element 104*d*; the axle 103*a* is at least in part more or less cylindrical in form. In this embodiment, the bearing element 104*d* incorporates the form of a circular opening 104*f* at the upper extent of at least one of the A-frame legs 104 within an A-frame leg pair 104*b*; this circular opening 104*f* receives the axle 103*a* in a pin type connection and functions as a bearing.

Liquid Fill Axle Embodiment(s)

Referring again to FIGS. 3*a*-3*c*, there are shown elevation views of an embodiment of the shelter system wherein the axle 103*a* is at least partially hollow and capable of containing liquid fill. In this embodiment, the axle 103*a* is also capable of receiving and then distributing liquid fill via a hose 107 and/or nozzle 107*a* apparatus as shown in FIGS. 3*a*-3*c*. FIG. 3*a* demonstrates the initial stage of the erecting process. The axle 103*a* is being filled while the erecting frame system 101 is substantially flat. FIGS. 3*b*-3*c* demonstrates the final stage of the erecting process; the axle 103*a* contains liquid fill and is positioned at its final displacement above the ground after the A-frame leg feet 104*a* are drawn together. As a consequence, a pressure head for the liquid within the axle 103*a* has been established relative to the protected volume below.

Central Member and Hinge Embodiment(s)

Figure 4B:
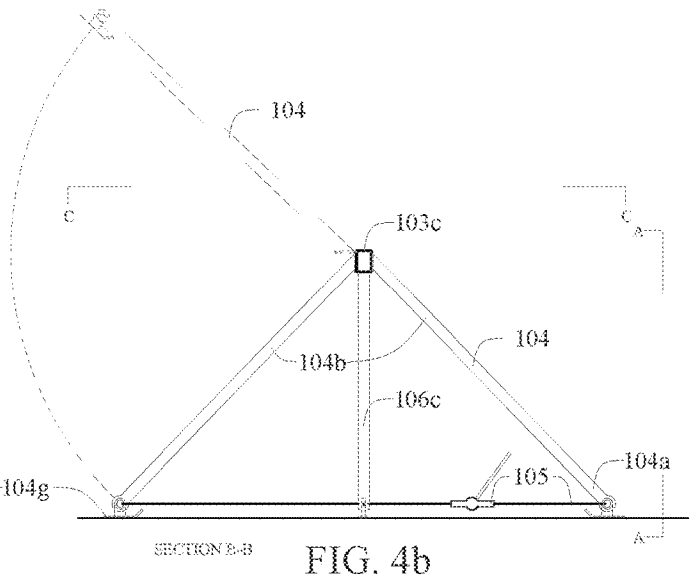
FIG. 4*b* is an elevation view of an embodiment of the erecting frame system demonstrating the inclusion of one lateral leg extending from each primary A-frame leg pair; the partial range of motion of an A-frame leg and hinge element is illustrated with phantom lines and a central member is illustrated.
Figure 4A:
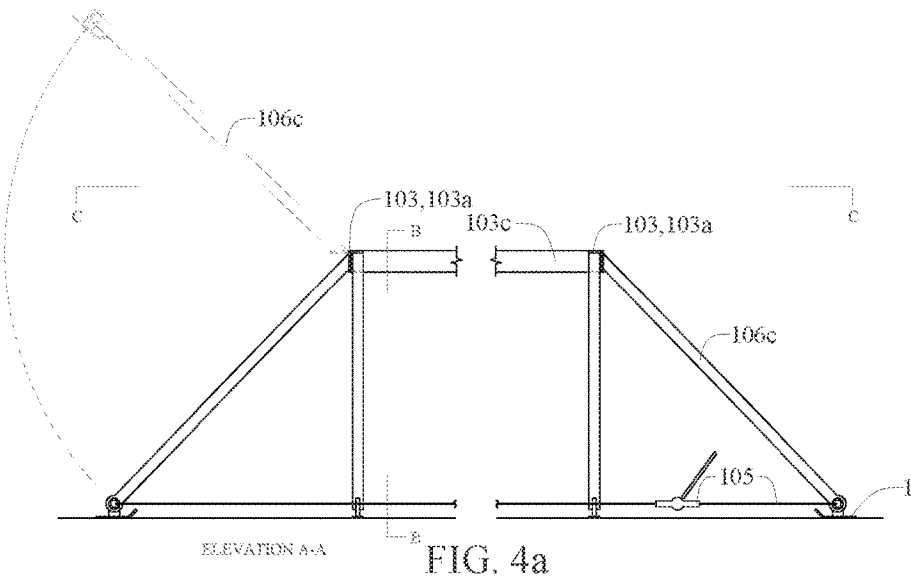
FIG. 4*a* is an elevation view of an embodiment of the erecting frame system demonstrating the inclusion of one lateral leg extending from each primary A-frame leg pair; the partial range of motion of the lateral leg and hinge element is illustrated with phantom lines and a central member is illustrated.
Figure 4C:
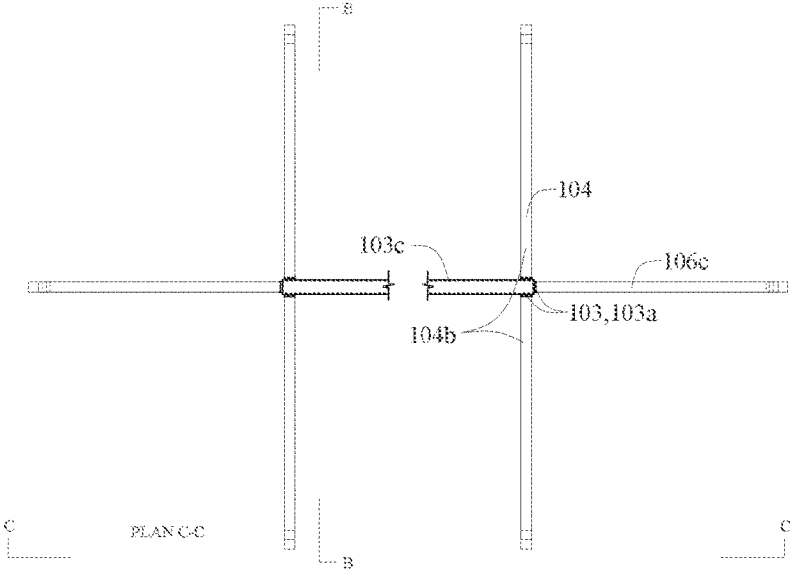
FIG. 4*c* is a plan view of an embodiment of the erecting frame system demonstrating the inclusion of one lateral leg extending from each primary A-frame leg pair and a central member is illustrated.

Referring now to FIGS. 4*a*-4*c*, there are shown elevation, section, and plan views of an alternate embodiment of the shelter system wherein the hinge or pin type connection 103 comprises hinge element 103*b* attached to a central member 103*c*. In this embodiment, the rotation of the hinge element 103*b* facilitates the ability of the A-frame leg feet 104*a* within an A-frame leg pair 104*b* to be drawn together; the central member serves as the point of coalescence and at least one hinge element 103*b* connects the upper extent of at least one of the A-frame legs 104 within an A-frame leg pair 104*b* to said central member 103*c*. In part, the function of the central member 103*c* of this alternate embodiment is differentiated from the function of the axle 103*a* of the preferred embodiment in that the provision for rotation between the central member 103*c* and an associated A-frame leg 104 is not a consequence of the form of the central member 103*c*. The primary roles of the central member 103*c* may include but are not limited to that of a structural spanning element, a support and/or attachment point for the protective skin system 102, and/or that of a connection point for the A-frame legs 104 and associated hinge element(s) 103*b*.

Tensioning Element Embodiment(s)

Referring now to FIGS. 2*a*-2*c*, there are shown elevation views of a preferred embodiment of the shelter system wherein the tensioning element 105 of the erecting frame system 101 comprises a cable 105*a* and winch 105*b* combination between the A-frame legs 104 within at least one A-frame leg pair 104*b*; each end of said cable 105*a* is at least temporarily secured to each A-frame leg foot 104*a* in a pair of A-frame legs 104. Following the generation of tension in the erecting process, the tensioning element may be replaced with a simple member in tension such as a cable 105*a* or other non-rigid structural member, as shown in FIG. 8*d*.

Figure 8B:
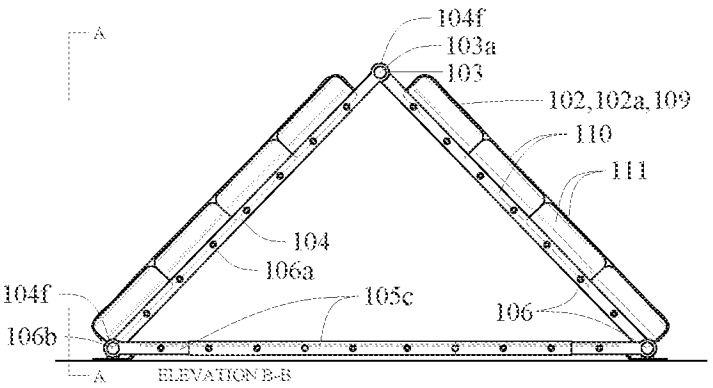
FIG. 8*b* is an elevation view of one embodiment of the shelter system wherein the protective skin system comprises at least one non-rigid vessel element and the tensioning element is rigid and adjustable.

Referring now to FIG. 8*b*, there is shown an elevation view of an alternate embodiment of the tensioning element 105 wherein a rigid tension member 105*c* is either used in place of said cable 105*a* during the tensioning process or is at least fastened in place of the cable 105*a* following the A-frame legs 104 being drawn at together by the tension force; said rigid tension member 105*c* may be adjustable in length.

Saddle Embodiment(s)

Referring now to FIGS. 2*a*-2*c*, there are shown elevation views of a preferred embodiment of the shelter system wherein the erecting frame system 101 further comprises a saddle 103*d*; the saddle 103*d* is any mass placed below the hinge or pin type connection 103 in order to offset the hinge or pin type connection 103 above the ground surface. The offset positioning initially facilitates the correct direction for displacement of the hinge or pin type connection 103 above the ground and reduces the initial force required by the tensioning element 105 during the erecting process.

Wheel and Skid Embodiment(s)

Figure 1B:
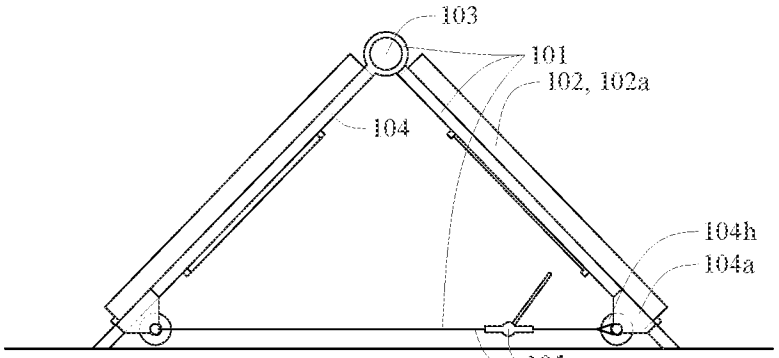
FIG. 1*b* is an elevation view of an embodiment of the shelter system wherein the A-frame leg feet of the erecting frame system have been pulled towards one another by the tensioning element to create an effective protected volume behind the protective skin system.

Referring now to FIGS. 1*a*-1*b* and 5*a*-5*d*, there are shown elevation views of a preferred embodiment of the shelter system wherein the foot of at least one A-frame leg 104 at least temporarily includes at least one wheel 104*h*. The wheel 104*h* reduces friction between the ground surface and the erecting frame system 101 during the tensioning portion of the erecting process. In consequence, the tension force required to initiate and sustain the erecting process is reduced. FIG. 1*a* illustrates an embodiment of shelter system wherein the A-frame leg feet 104*a* have been pulled partially towards one another by the tensioning element 105. A wheel 104*h* is present at each A-frame leg foot 104*a* FIG. 1*b* illustrates an additional embodiment wherein each wheel 104*h* is positioned such that it breaks contact with the ground surface as the A-frame leg feet 104*a* are drawn together and reach a desired angle with the ground surface.

Referring now to FIGS. 2*a*-2*c*, there are shown elevation views of an alternate embodiment of shelter system wherein at least one A-frame leg foot 104*a* further comprises a skid 104*g*. The skid 104*g* reduces friction between the ground surface and the erecting frame system 101 during the tensioning process. In an additional embodiment of the skid 104*g*, the skid 104*g* is attached at the A-frame leg foot 104*a* in a pin type connection, thereby permitting the skid 104*g* to remain oriented more or less normal to the plane of the ground surface even as the A-frame legs 104 are drawn together via the tensioning element 105 during the erecting process; this characteristic is illustrated in FIGS. 2*a*-2*c*.

Track Embodiment(s)

Figure 7A:
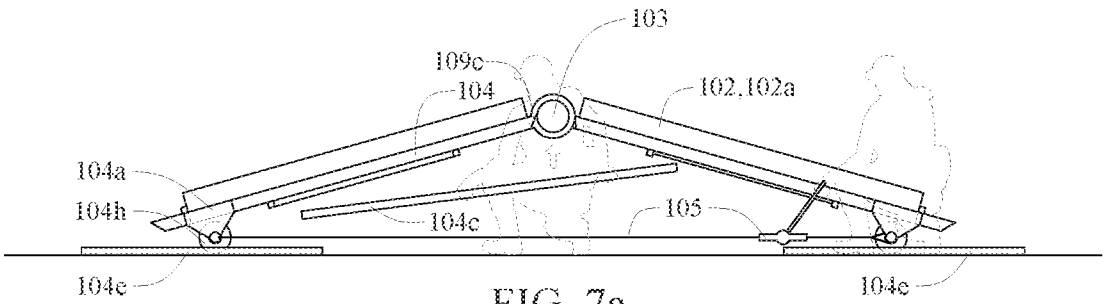
FIG. 7*a* is an elevation view of an embodiment of the shelter system wherein the A-frame leg feet of the erecting frame system have been pulled partially towards one another by the tensioning element and wheel components are attached at the free ends of the A-frame legs to assist in the erecting process.
Figure 7B:
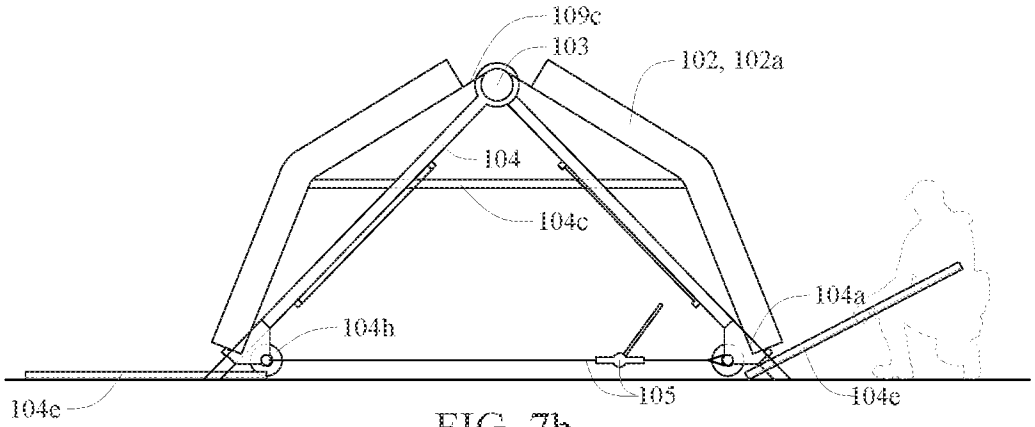
FIG. 7*b* is an elevation view of an embodiment of the shelter system wherein the A-frame leg feet of the erecting frame system have been pulled towards one another by the tensioning element to create an effective protected volume behind the protective skin system; one track element is positioned below one of said wheel components; a second track element is removed to be utilized elsewhere; a thwart element is positioned between two planar elements and provides a thrust force to increase the volume within the shelter.

Referring now to FIGS. 7*a*-7*b*, there are shown elevation views of an embodiment of the shelter system wherein a track element 104*e* is at least temporarily positioned below at least one A-frame leg foot 104*a* or at least one wheel 104*h* or skid 104*g* attached to at least one A-frame leg foot 104*a* during the erecting process of the shelter system. Said track element is a surface that is smooth and rigid relative to the ground surface; said track element 104*e* serves the role of reducing the friction force(s) acting on said A-frame leg foot 104*a*, wheel 104*h*, or skid 104*g* during the erecting process. In a preferred embodiment of the track element, the track element 104*e* is in the form of a thin channel piece, as shown in FIGS. 7*a*-7*b*; the channel form assists with guiding the A-frame leg foot 104*a*, wheel 104*h*, or skid 104*e* and the flanges of the channel form assist with providing rigidity to the track element 104*j*. Following the completion of the erecting process, the track element 104*e* may be removed and used elsewhere.

Pairs of Parallel A-Frame Embodiment(s)

In a preferred embodiment, at least two A-frame leg pairs 104*b* are substantially parallel to, and offset from one another as shown in FIGS. 3*a*-3*c*, 4*a*-4*c*, and 5*a*-5*d*.

Lateral Bracing Embodiment(s)

Referring now to FIGS. 3*b*-3*c*, 5*a*-5*d* and 9*a*-9*b* there are shown elevation and plan views of embodiments of the shelter system wherein the erecting frame system 101 further comprises lateral bracing 106 between at least two A-frame legs 104 that are not part of the same constituent A-frame leg pair 104*b*. lateral bracing 106 may be defined as any structural member, component, or assembly thereof that provide(s) resistance to lateral loads and provide(s) stability to the erecting frame system 101.

Figure 8A:
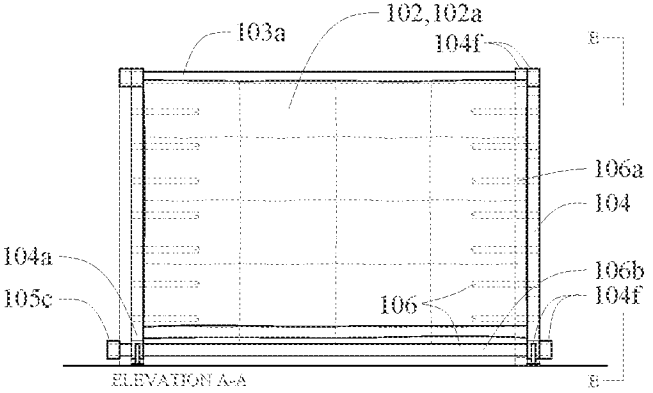
FIG. 8*a* is an elevation view of one embodiment of the shelter system wherein the protective skin system comprises at least one non-rigid vessel element and the tensioning element is rigid and adjustable.
Figure 8D:
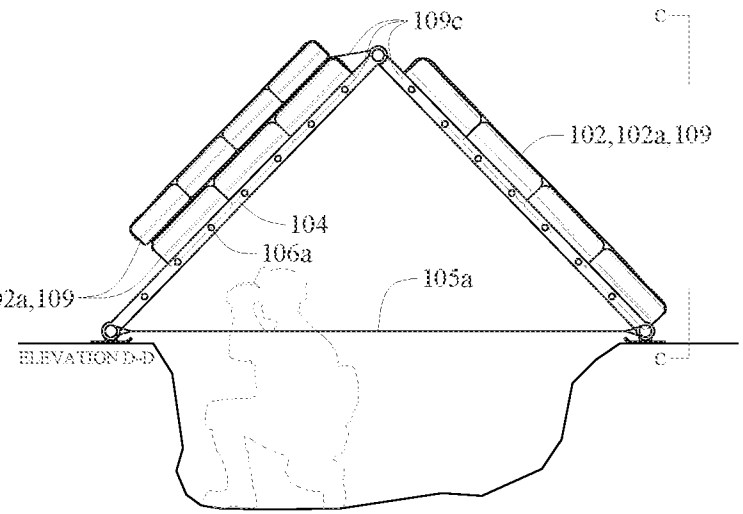
FIG. 8*d* is an elevation view of one embodiment of the shelter system wherein the protective skin system comprises at least one non-rigid vessel element and a cable is illustrated connecting the free ends of an A-frame leg pair.

In a preferred embodiment, the lateral bracing 106 may serve an additional role as a support and/or attachment point for the protective skin system 102, as shown in FIGS. 8*a*-8*b* and 19*a*.

In one embodiment, the lateral bracing 106 comprises at least one rigid lateral member 106*a* that runs orthogonally from one of A-frame leg pair 104*b* to that of another offset A-frame leg pair 104*b*, as shown in FIGS. 5*a*-5*d*. At least part of said rigid lateral member 106*a* may be housed in, formed with, affixed to, or fastened to at least one A-frame leg 104 within each of at least two distinct of A-frame leg pairs 104*b*.

In one embodiment, at least one rigid lateral member 106*a* runs orthogonally from the A-frame leg foot 104*a* and connects to the proximate A-frame leg foot 104*a* of at least one other A-frame leg 104 as shown in FIGS. 6*a*-6*d* and 8*a*-8*b*. Referring now to FIGS. 6*a*-6*d* there are shown elevation and plan views of an additional embodiment of shelter system wherein said rigid lateral member 106*a* may serve as a footer support for a protective skin system 102; in this embodiment, this rigid lateral member 106*a* located at the foot of an A-frame leg 104 may be referred to as a footing member 106*b*.

In an additional embodiment of the footing member 106*b*, each A-frame leg foot 104*a* has a circular opening 104*f* that serves as a bearing for at least one footing member 106*b* as shown in FIGS. 6*a*-6*d* and 8*a*-8*d*. This footing member 106*b* may take the form similar to the axle 103*a*, as shown in FIGS. 8*a*-8*d*.

Figure 5A:
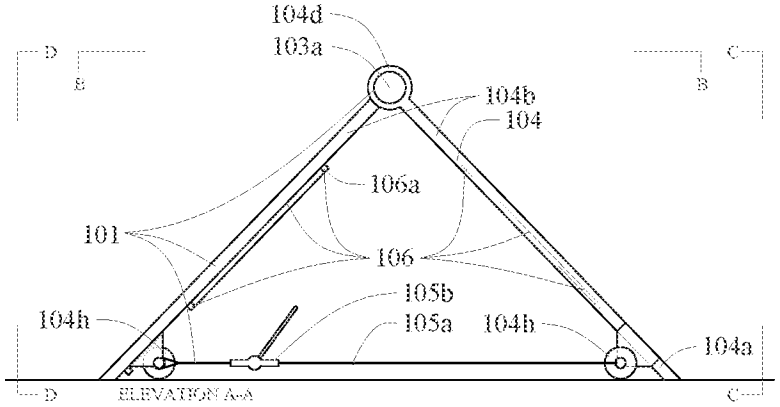
FIG. 5*a* is an elevation view of one embodiment of the erecting frame system demonstrating two embodiments of lateral bracing.
Figure 5B:
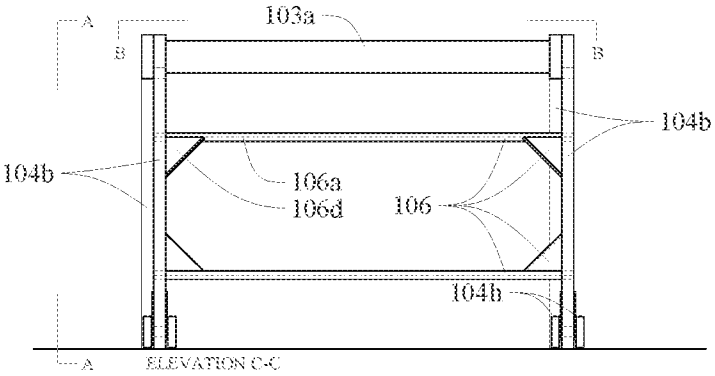
FIG. 5*b* is an elevation view of one embodiment of the erecting frame system demonstrating rigid lateral members with gussets used for lateral bracing.
Figure 5C:
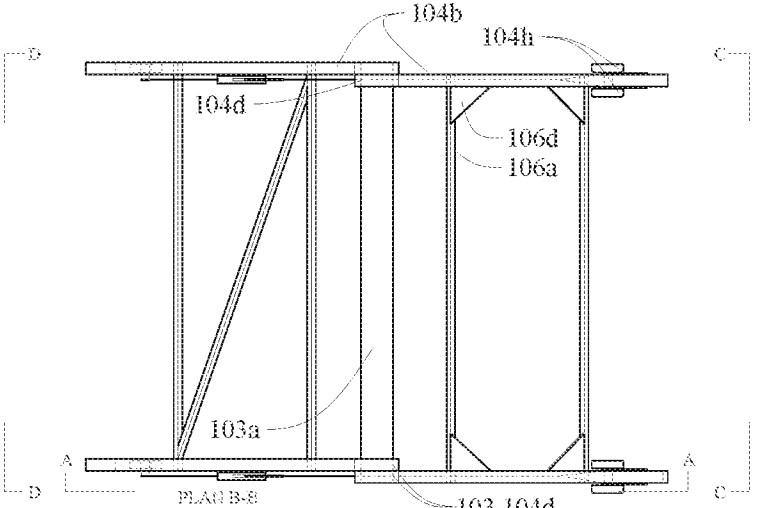
FIG. 5*c* is a plan view of one embodiment of the erecting frame system demonstrating embodiments of lateral bracing, rigid lateral members, a rigid diagonal member, and lateral bracing gussets.
Figure 5D:
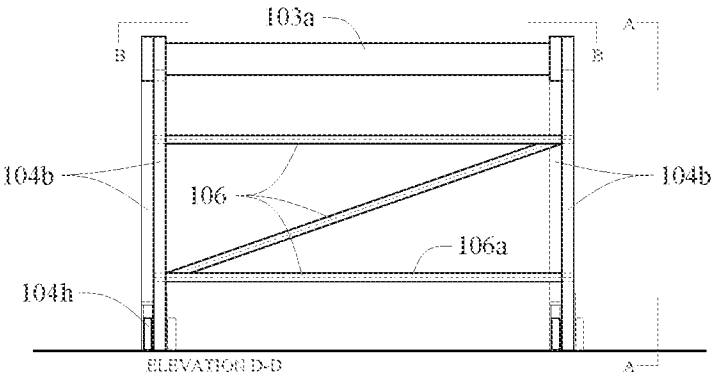
FIG. 5*d* is an elevation view of one embodiment of the erecting frame system demonstrating lateral bracing.

Referring now to FIGS. 5*c*-5*d*, and 3*c*, there are shown elevation and plan views of an embodiment of erecting frame system wherein the lateral bracing 106 further comprises at least one structural component or member disposed in a diagonal arrangement; the diagonal arrangement more or less equates to an assembly wherein said structural member or component(s) of the lateral bracing 106 extend(s) from the proximate A-frame leg foot 104*a* to the proximate upper portion of another A-frame leg 104. Said structural component or member of the lateral bracing 106 may be rigid, semi-rigid, non-rigid in construction or some combination thereof. This arrangement may be referred to as a diagonal arrangement of the lateral bracing 106.

In one embodiment of the diagonal arrangement, said structural component or member of the lateral bracing 106 is in the form of at least one tension cable. This form of lateral bracing may be referred to as a bracing cable 106*e*.

In one embodiment of the diagonal arrangement, at least one bracing cable 106*e* at least temporarily makes use of a winch 105*b* to tighten the bracing cable 106*e*.

In one embodiment of the diagonal arrangement, the lateral bracing 106 further comprises at least two structural components or members disposed in an 'x' or 'cross' pattern, as shown in FIG. 3*c*.

Referring now to FIGS. 5*a*-5*d*, there are shown plan views and elevation views of an embodiment of the erecting frame system 101 demonstrating additional embodiments of lateral bracing 106.

In one alternate embodiment of the lateral bracing 106, a rigid lateral member 106*a* further comprises gussets 106*d* located at the intersection of a rigid lateral member 106*a* with the A-frame legs 104 as shown in FIGS. 5*b*-5*c*. Gussets 106*d* may take the form of, but are not limited, gusset plates and/or gusset members.

In one embodiment of the lateral bracing 106, an A-frame leg pair 104*b* is laterally braced by at least one lateral leg 106*c*, as shown in FIGS. 4*a*-4*c*. Said lateral leg 106*c* extends from the proximate point of coalescence of two A-frame legs 104 within an A-frame leg pair 104*b* to the ground surface; said lateral leg 106*c* is oriented more or less perpendicular to the plane of the A-frame leg pair 104*b* if viewed in plan. The foot of each lateral leg 106*c* may be connected by lateral bracing 106*a*, in the form of a cable or other structural component, to at least one other foot, be it that of another lateral leg 106*c* or an A-frame leg foot 104*a*, in order to provide further provide stability.

In a further embodiment of the lateral leg 106*c*, the lateral leg 106*c* is connected to the pair of A-frame legs 104 via a hinge element 103*b*. FIG. 4*a* illustrates a partial range of motion of the lateral leg 106*c* via the hinge element 103*b* connection type via phantom lines.

Referring now to FIG. 4*a*, there is shown an elevation view of an embodiment of the erecting frame system wherein the erecting frame system further comprises at least one pair of lateral legs 106*c*; said pair 106*c* may be drawn together in a similar manner to, or in place of, the A-frame leg feet 104*a* within an A-frame leg pair 104*b* previously referenced in the description of the erecting process. In a further embodiment of the lateral leg 106*c*, at least one wheel 104*h* and/or skid 104*g* element may be at least temporarily attached to the foot of the lateral leg 106*c* in a similar manner to the A-frame leg foot 104*a* previously referenced in the description of the wheel 104*h* and skid 104*g* embodiments. This use of the skid 104*g* and/or wheel 104*h* with the lateral legs 106*g* may reduce the force required to draw said lateral leg 106*c* together.

The embodiments of lateral bracing described and illustrated may be used in combination with one another and/or with alternate methods of lateral bracing not explicitly detailed in this description. The embodiments of lateral bracing described and illustrated may be used independently of one another.

Erecting Tower Embodiment(s)

Figure 11A:
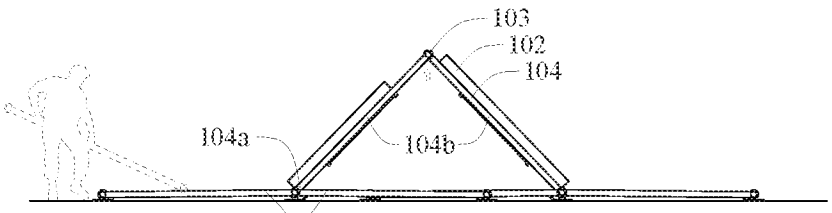
FIG. 11*a* is an elevation view of an embodiment of the shelter system wherein additional A-frame legs are attached to the primary erecting frame to raise the protected volume above the ground surface.
Figure 11B:
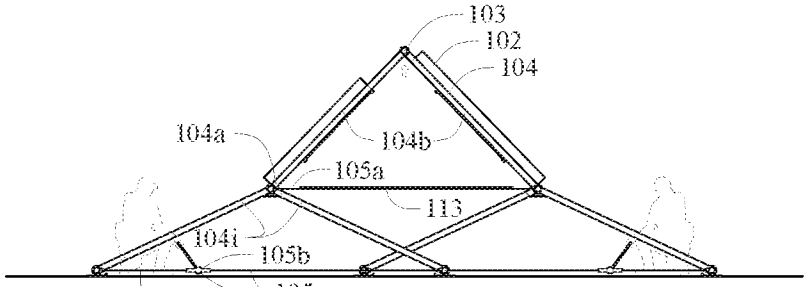
FIG. 11*b* is an elevation view of an embodiment of the shelter system wherein additional A-frame legs are attached to the primary erecting frame to raise the protected volume above the ground surface.
Figure 11C:
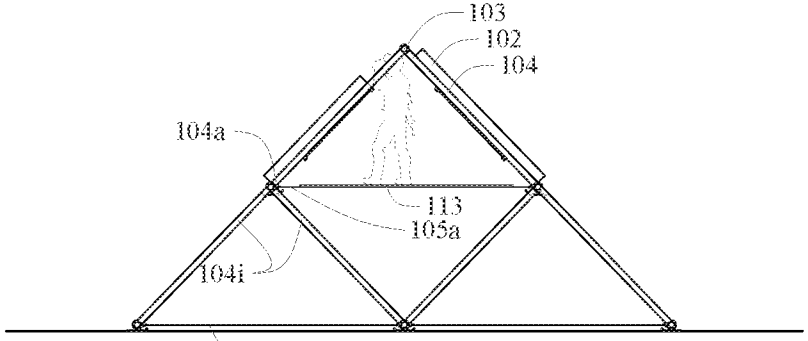
FIG. 11*c* is an elevation view of an embodiment of the shelter system wherein additional A-frame legs are attached to the primary erecting frame to raise the protected volume above the ground surface.

Referring now to FIGS. 11*a*-11*c* there are shown elevation views of an embodiment of shelter system wherein the erecting frame system 101 further comprises at least two additional A-frame legs 104*i* of similar arrangement to the primary A-frame legs 104; the additional A-frame legs 104*i* may be at least temporarily affixed to each A-frame leg foot 104*a* used to support the shelter. As demonstrated in FIG. I1*b*, The additional pairs of A-frame legs 104 serve to raise the protected volume off the ground surface by drawing the feet of the additional A-frame legs 104*i* together with a tensioning element I05 in a similar manner used to erect the primary A-frame legs 104. These additional A-frame legs 104*i* may remain in place for the extent of a shelter system's deployment or they may be used to temporarily raise a shelter system above the ground surface while another unspecified supporting structure is inserted or constructed below. This technique of attaching additional pairs of A-frame legs 104 to each A-frame leg foot 104*a* that is in contact with the ground surface may be repeated to raise the protected volume to greater and greater heights. In a further embodiment of this raised shelter system scheme, a floor surface 113 may be positioned above and supported by the tensioning element 105, rigid tension member 105*c*, or cable 105*a* of the tensioning element 105 as illustrated in FIG. 11*e*.

Protective Roof Embodiment(s)

Figure 12A:
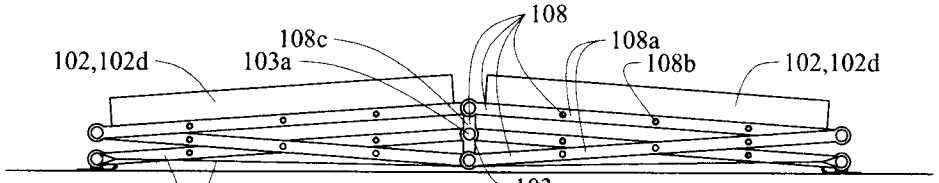
FIG. 12*a* is an elevation view of an embodiment of the shelter system wherein a protective roof structure is included.
Figure 12B:
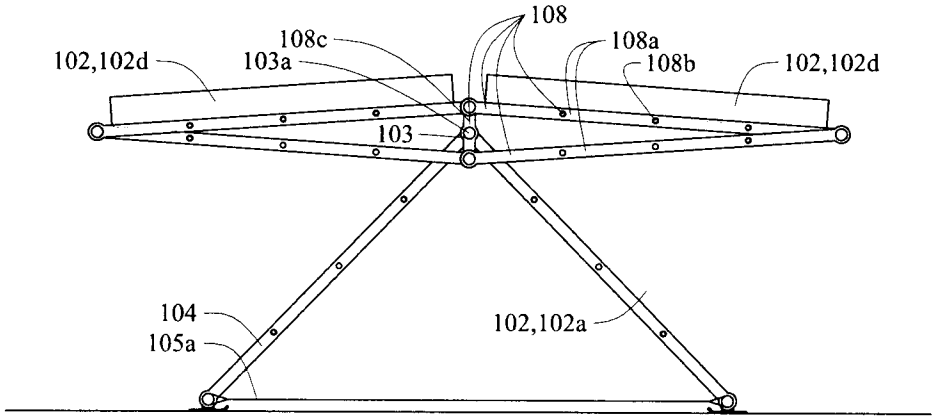
FIG. 12*b* is an elevation view of an embodiment of the shelter system wherein a protective roof structure is included and the A-frame legs are drawn together by tensioning elements, thereby raising the protective roof structure and associated roof protection planar element above the ground surface.

Referring now to FIGS. 12*a*-12*b*, there are shown elevation views of an embodiment of the shelter system wherein the erecting frame system 101 further comprises a protective roof structure 108. The primary function of the protective roof structure 108 is to support and transfer the loading of embodiments that include a protective skin system 102 positioned on the roof plane. A roof plane of the erecting frame system IO I may be defined as a plane more or less concordant with the ground surface and more or less of a similar elevation above the ground surface as is the hinge or pin-type connection 103 point of at least two primary A-frame legs 104. The portion of the protective skin system position on the roof plane may be referred to as a roof protection planar element 102*d*.

In one embodiment, the protective roof structure 108 may be affixed to the central member 103*c* or axle 103*a*.

In one embodiment of the protective roof structure 108, the protective roof structure 108 further comprises: a plurality of rafter elements 108*a* extending laterally from and affixed to the central member 103*c* or axle 103*a*, purlin elements 108*b* extending laterally from and affixed to at least two rafter elements 108*a* that are offset one from the other, and a protective skin system 102 at least partially occupies the plane between the rafter elements 108*a* and rests on and/or is affixed to said purlin elements 108*b*.

In one embodiment of the protective roof structure 108, the protective roof structure 108 further comprises a hinge or pin type connection 103 where the protective roof structure 108 meets the central member 103*c* or axle 103*a* of the erecting frame system 101. This connection type allows for the controlled rotation of the protective roof structure 108 relative to the rest of the erecting frame system 101 below. In an alternate embodiment, the protective roof structure 108 is affixed to the axle 103*a* in a fixed connection type and it is the hinge or pin-type connection 103 between the axle 103*a* and the A-frame legs 104 that permits the controlled rotation of the protective roof structure 108.

Figure 13A:
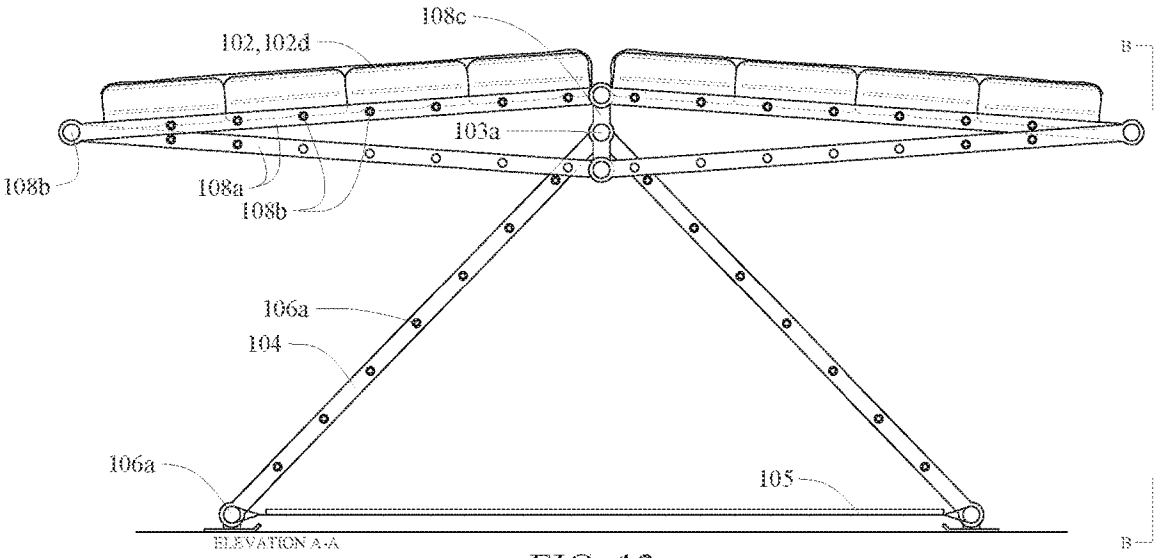
FIG. 13*a* is an elevation view of an embodiment of the shelter system wherein a protective roof structure is included and a shaped roof bearing element is illustrated.
Figure 13B:
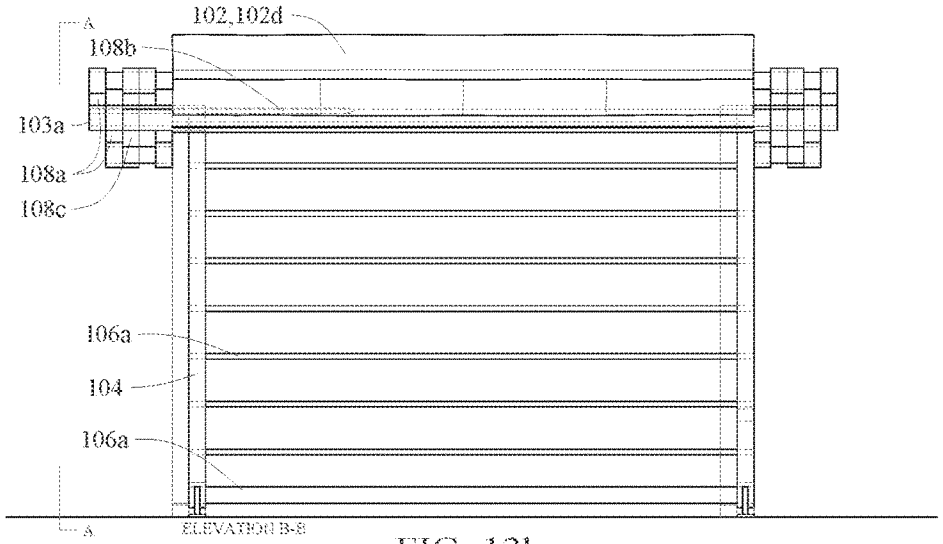
FIG. 13*b* is an elevation view of an embodiment of the shelter system wherein a protective roof structure is included.

In one embodiment of the protective roof structure 108, the protective roof structure 108 comprises rafter elements 108*a* and purlin elements 108*b* that utilize similar, if not identical, components as the A-frame legs 104 and the rigid lateral members 106*a* of the primary A-frame leg 104 assembly, respectively, as shown in FIGS. 12*a*-12*b*. In a further embodiment of the protective roof structure 108, the rafter element 108*a* further comprises: a shaped roof bearing element 108*c* affixed to the axle 103*a*, and at least two members of a rafter element 108*a*; said members of the rafter element, being affixed to and extending from opposite extents of the shaped roof bearing element 108*c*, coalesce at their other extreme ends, as shown in FIG. 13*a*.

In further embodiments of the shaped roof bearing element 108*c*, the attachment of the shaped roof bearing element 108*c* to the axle 103*a* may be of a pin type connection or a moment resistant connection; in either case, the protective roof structure 108 may be able to rotate given the pin-type connection between the axle 103*a* and the A-frame legs 104 and/or the pin-type connection between the rafter elements 108*a* and the axle 103*a*.

Referring now to FIGS. 12*a*-12*b*, there are shown elevation views of one embodiment of the shelter system wherein the protective skin system 102 is provided on the roof plane. These figures demonstrate stages of the erecting process. Referring now to FIG. 12*a*, the shelter system is in the initial stage of the erecting process and the protective skin system 102 has been assembled on the protective roof structure 108 while the entire erecting frame system 101 is substantially flat. Referring now to FIG. 12*b*, the A-frame legs 104 of the erecting frame system 101 have been drawn together by the tensioning element 105 in order to establish a protected volume below; a cable 105*a* remains in place of the tensioning element 105.

The Protective Skin System

Figure 9A:
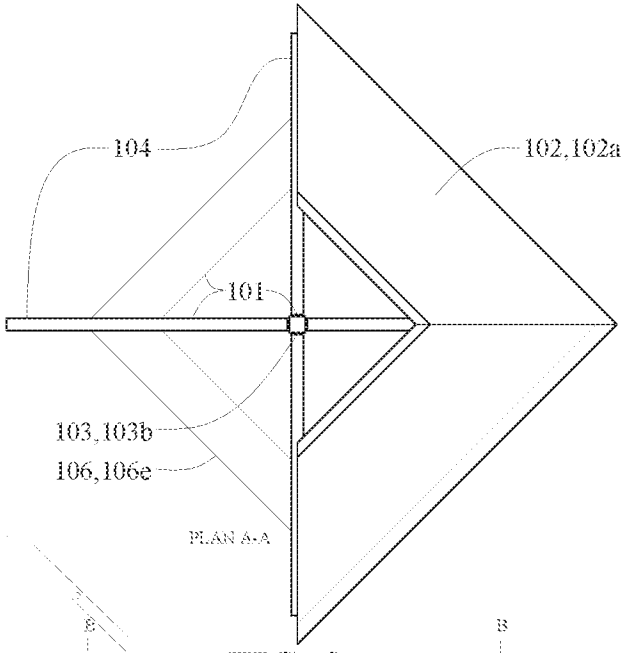
FIG. 9*a* is a plan view of an embodiment of the shelter system wherein the erecting frame system includes two A-frame leg pairs connected by hinge elements, each pair being orthogonal to one another.
Figure 9B:
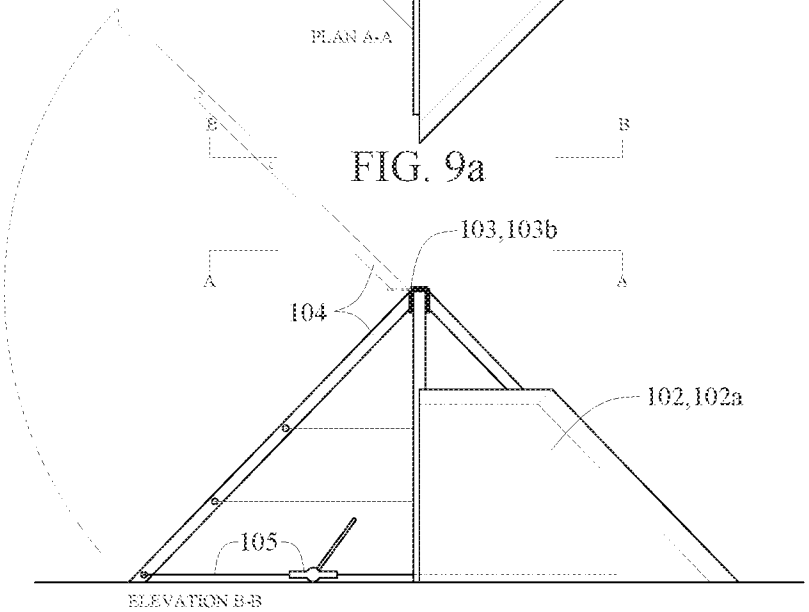
FIG. 9*b* is an elevation view of an embodiment of the shelter system wherein the erecting frame system includes two A-frame leg pairs connected by hinge elements.

The protective skin system 102 comprises at least one planar element 102*a*, as shown in FIGS. 9*a*-9*b*, or a composition of adjacent masses 102*b* arranged in such a manner so as to compose a planar element 102*a*, as shown in FIGS. 6*a*-6*d*. The role of the protective skin system 102 is to shield a protected volume within, below, and/or behind the shelter. The protected volume may be defined as a space or volume behind and/or below at least one planar element 102*a*. As a consequence, the planar element 102*a* must be a barrier capable of at least partially mitigating a common ballistic threat and/or providing general protection from the natural elements for protected volume. For the sake of delineation and for the purpose of this invention, a common ballistic threat may be defined at minimum as shrapnel from indirect fire and rifle rounds from direct fire. Therefore, the protective skin system 102 at least in part comprises materials of dimension and form capable of providing an at least partial barrier from a ballistic threat and/or the natural elements. The protective skin system 102 at least in part rests upon or is supported by the erecting frame system 101. The loading of and on the protective skin system 102 is transferred at least in part first to the erecting frame system 101 and ultimately to the ground surface.

The forces required to arrange the protective skin system 102 into a position to provide a usable protected volume may be referred to as arrangement forces. It should be noted that the application of the arrangement forces is streamlined by the pairing of the protective skin system 102 with the erecting frame system 101.

The most obvious case for this streamlining is the transition of the erecting frame system 101 from being splayed more or less flat on the ground surface to its final conversion into a volumetric shape as demonstrated in FIGS. 2*a*-2*c*. The majority of protective skin system's 102 assembly tasks may be carried out while the protective skin system 102 is positioned near the ground surface. Additionally, the pairing of the protective skin system 102 with the erecting frame system 101 allows for a greater percentage of the work associated with the arrangement forces to be facilitated by a device providing a mechanical advantage. The most obvious case is the utilization of a winch 105*b* to draw the A-frame legs 104 partially together.

The work associated with the arrangement forces may become an imposition without the erecting frame and mechanical device; that is to say: 1) the work may be tedious if the protective skin is assembled in the non-flat position or 2) if assembly takes place near the ground surface/flat position, then the concentrated force required to lift the protective skin system 102 may be too great for an individual or group of individuals without access to devices providing mechanical advantage. Given this relationship, the access to mechanical advantage provided through the erecting frame system 101 affords utility in overcoming a common weight-to-ballistic protection performance conundrum; said conundrum is the simple adage that more protection typically results in a heavier protective system.

In one embodiment, the protective skin system 102 may be fastened at least temporarily to the erecting frame system 101.

In one embodiment, the protective skin system 102 may be at least in part formed with or molded to the erecting frame system 101.

In one embodiment, the protective skin system 102 may be at least in part an independent component or an independent set of components from the erecting frame system 101.

At least one planar element 102*a* of the protective skin system 102 is more or less concordant with and occupies at least one side plane, roof plane, and/or end plane of the erecting frame system 101.

A side plane of the erecting frame system 101 may be defined as a plane more or less concordant with and/or occupying the plane between at least two A-frame legs 104 of at least two distinct A-frame leg pairs 104*b* of the erecting frame system 101, as shown in FIGS. 6*a*-6*d* and 9*a*-9*b*.

Figure 14B:
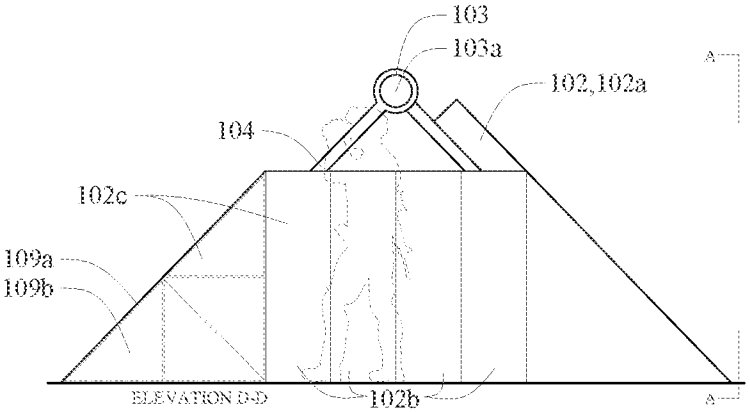
FIG. 14*b* is an elevation view of one embodiment of the shelter system wherein end protection planar elements are included.
Figure 14A:
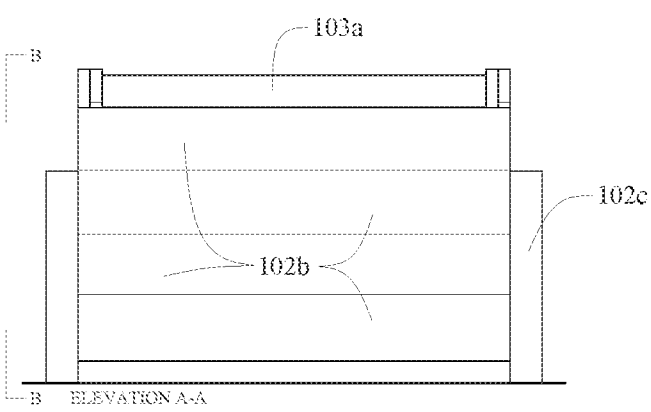
FIG. 14*a* is an elevation view of one embodiment of the shelter system wherein end protection planar elements are included.

An end plane of the erecting frame system 101 may be defined as a plane more or less concordant with and/or occupying the plane between two constituent A-frame legs 104 of an A-frame leg pair 104*b* and the ground surface, as shown in FIGS. 14*a*-14*b*.

A roof plane of the erecting frame system 101 may be defined as a plane more or less concordant with the ground surface and more or less of a similar elevation above the ground surface as is a hinge or pin-type connection 103 of at least two primary A-frame legs 104, as shown in FIG. 12*b*.

Vessel Element and Internal Ballistic Protective Element Embodiment(s)

Referring now to FIGS. 16*a*-16*d* and 20*a*-20*c*, there are shown axonometric views of embodiments of the protective skin system 102, wherein the planar element 102*a* comprises at least one vessel element 109, a containment system 110, and at least one internal ballistic protection element 111. The vessel element 109, containment system 110, and the internal ballistic protection element 111 may be constructed of a wide range of materials, including those that are non-rigid, semi-rigid, rigid, or any combination thereof.

Figure 18A:
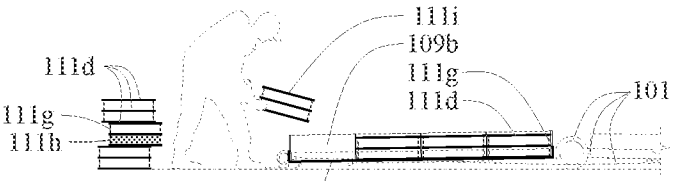
FIG. 18*a* is a diagrammatic section view of a filling process used to establish internal ballistic protection elements within vessel element compartments in one embodiment of the protective skin system, the internal ballistic protection element comprising a spaced armor assembly.
Figure 18B:
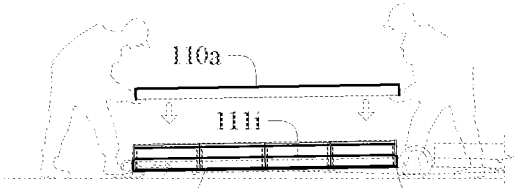
FIG. 18*b* is a diagrammatic section view of a filling process used to establish internal ballistic protection elements within vessel element compartments in one embodiment of the protective skin system.
Figure 18C:
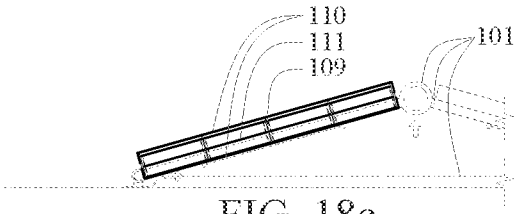
FIG. 18*c* is a diagrammatic section view of a filling process used to establish internal ballistic protection elements within vessel element compartments in one embodiment of the protective skin system, the internal ballistic protection element comprising a spaced armor assembly.
Figure 17A:
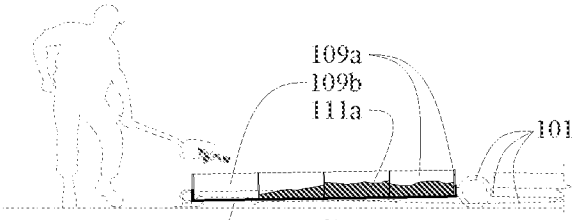
FIG. 17*a* is a diagrammatic section view of a filling process used to establish particle fill within vessel element compartments in one embodiment of the protective skin system with particle fill only.
Figure 17B:
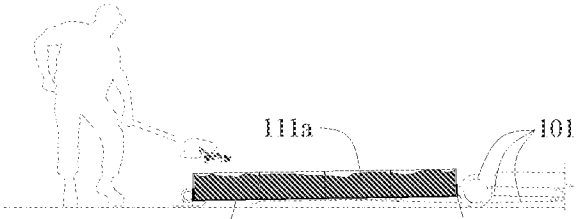
FIG. 17*b* is a diagrammatic section view of a filling process used to establish particle fill within vessel element compartments in one embodiment of the protective skin system, the internal ballistic protection element comprising particle fill only.
Figure 17C:
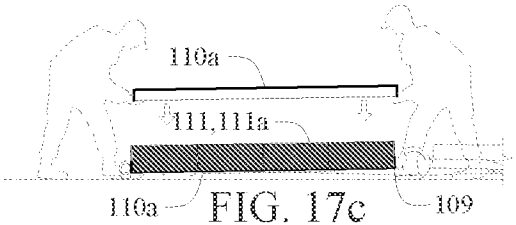
FIG. 17*c* is a diagrammatic section view of a filling process used to establish particle fill within vessel element compartments in one embodiment of the protective skin system, the internal ballistic protection element comprising particle fill only.
Figure 17D:
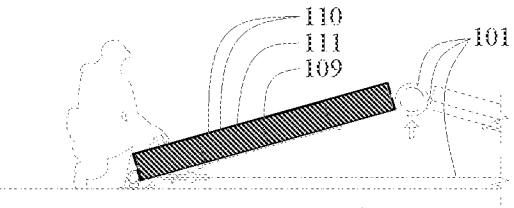
FIG. 17*d* is a diagrammatic section view of a filling process used to establish particle fill within vessel element compartments in one embodiment of the protective skin system.

The vessel element 109 and internal ballistic protection element 111 based embodiments of the protective skin system 102 allow for non-particle fill based internal ballistic protection element embodiments as shown in FIGS. 18*a*-18*c* and/or particle fill based internal ballistic protection element embodiments as shown in FIGS. 17*a*-17*d*, 19*a*-19*f*, and 21*a*-21*g* to utilize the same vessel element 109 system for containment. The choice of, and the swapping of, internal ballistic protection element 111 embodiments can be tailored to deployment environment(s) and mission parameters. The vessel element 109 and internal ballistic protection element 111 based system also allows for efficient upgrading of the internal ballistic protection element 111.

The Vessel Element

Figure 16A:
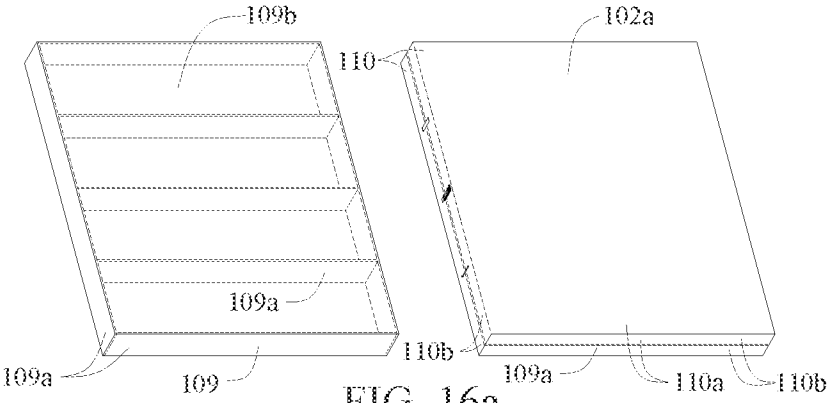
FIG. 16*a* is an axonometric view of a vessel element embodiment on the left and the same vessel element embodiment at least partially sealed by its respective embodiment of the containment system on the right.
Figure 16B:
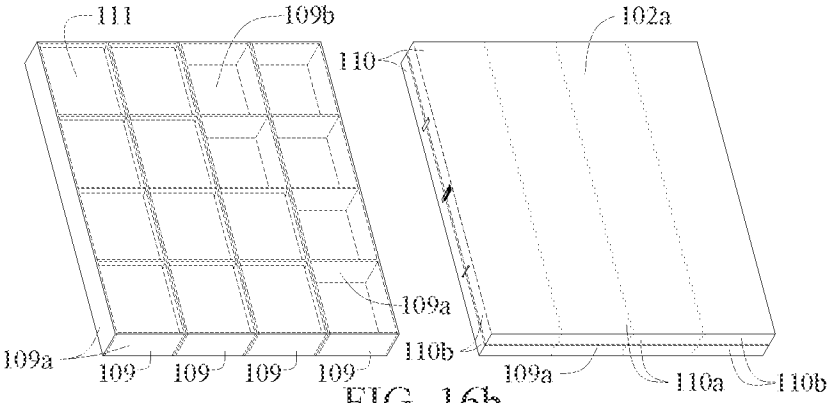
FIG. 16*b* is an axonometric view of a multiple vessel element embodiment of the planar element on the left and an embodiment wherein the multiple vessel elements are at least partially sealed by their own respective containment systems on the right.
Figure 16C:
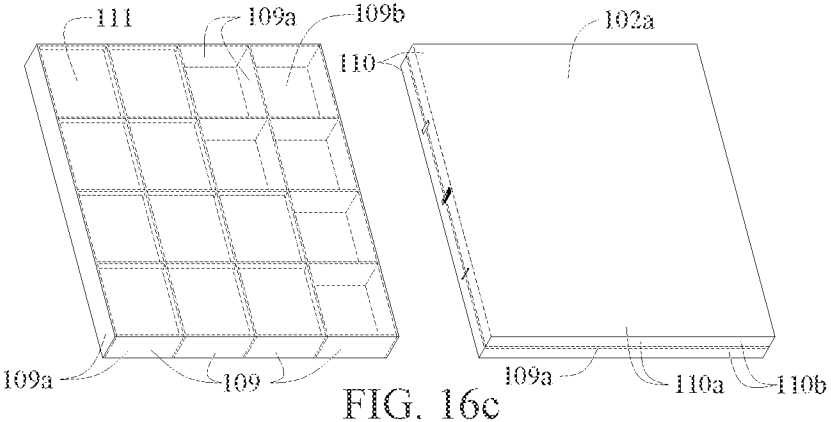
FIG. 16*c* is an axonometric view of a multiple vessel element embodiment of the planar element on the left and an embodiment wherein the multiple vessel elements are at least partially sealed by a single containment system on the right.
Figure 16D:
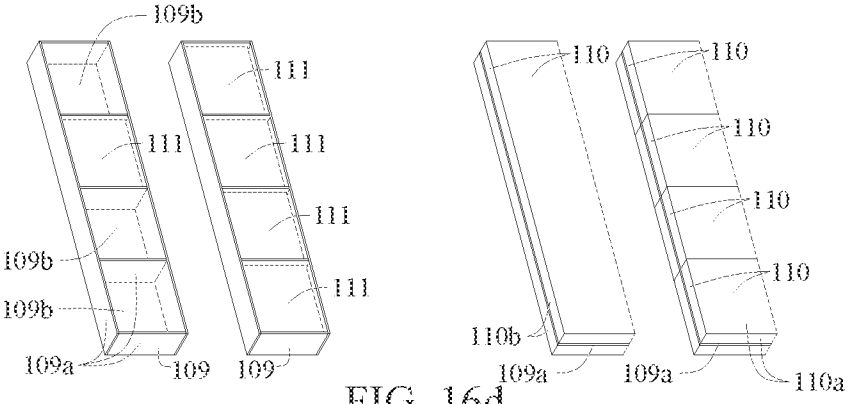
FIG. 16*d* is an axonometric view of two vessel element embodiments on the left and an embodiment wherein the each vessel element is at least partially sealed by its own respective containment systems on the right and the containment system illustrated on the far right demonstrates each compartment has its own containment system.
Figure 20C:
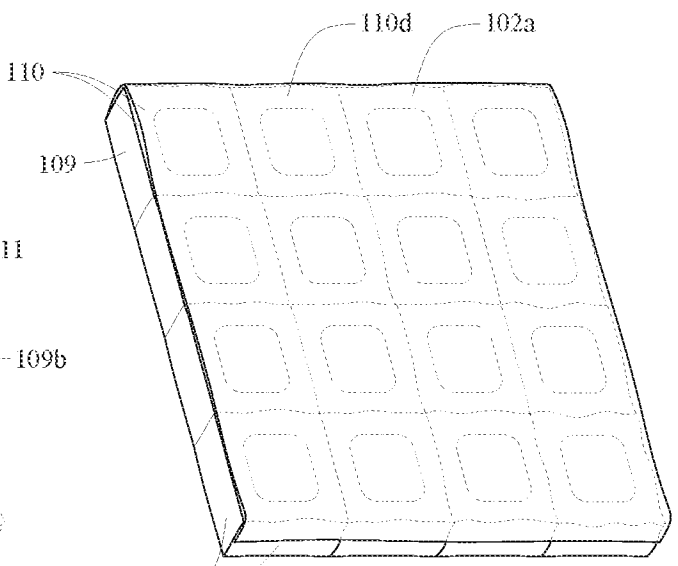
FIG. 20*c* is an axonometric view of a non-rigid vessel element based embodiment of the protective skin system, the non-rigid vessel element embodiment having a planar element wherein multiple compartments are covered by a single additional enclosure element.
Figure 20B:
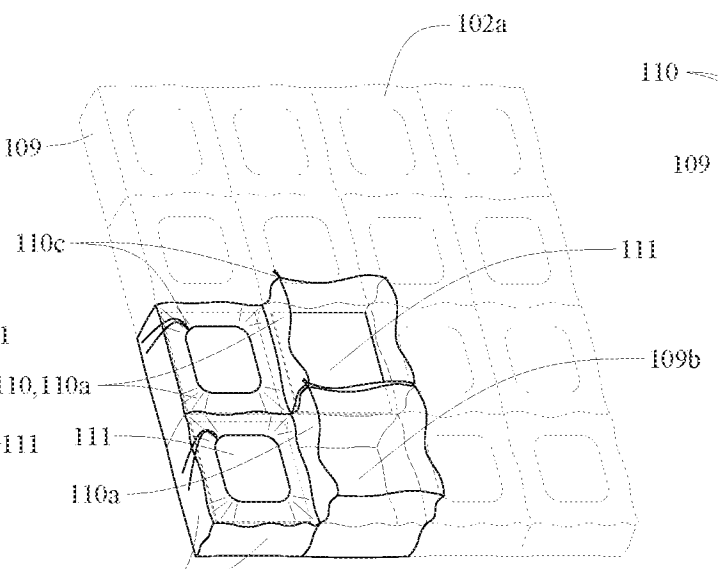
FIG. 20*b* is an axonometric view of a non-rigid vessel element based embodiment of the protective skin system, two drawstring activated enclosure elements being open and two drawstring activated enclosure elements being constricted.
Figure 20A:
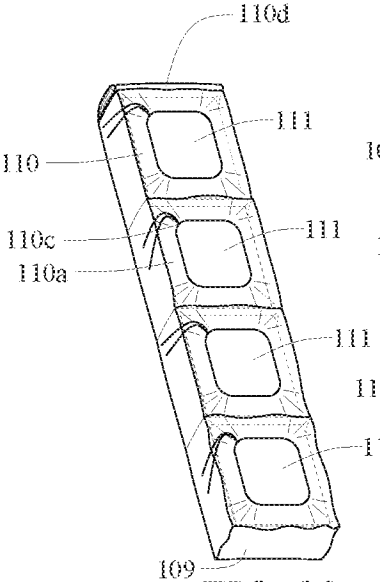
FIG. 20*a* is an axonometric view of a non-rigid vessel element based embodiment of the protective skin system.

Referring now to FIGS. 16*d* and 20*b*, there are shown axonometric views of primary embodiments of the shelter system wherein the vessel element 109 further comprises a plurality of sidewalls 109*a*. The length and thickness of each sidewall 109*a* may be different or similar to each of the other sidewalls 109*a*; the depth of each sidewall 109*a* should be approximately equal to each of the other sidewalls 109*a*. Each sidewall 109*a* attaches to at least two other sidewalls 109*a*; the outer perimeter of the attached sidewalls 109*a* forms at least one closed shape when viewed in plan and establishes an internal volume. This internal volume may be referred to as a compartment 109*b*.

Vessel Element Arrangements

Referring now to FIGS. 16*a*-16*d*, there are shown axonometric views of embodiments of the protective skin system wherein the vessel element sidewall 109*a* arrangement further comprises at least two sets of parallel side walls 109*a*. In this preferred embodiment, a plurality of parallel sidewalls 109*a* run perpendicular to and intersect with a plurality of parallel sidewalls 109*a* to form a grid pattern. The number, geometric size, and shape of the compartments 109*b* are determined by the number of sidewalls 109*a* in each parallel set. FIGS. 16*a*-16*d* demonstrate several potential embodiments of the vessel element 109; the number, proportions and arrangements of compartments 109*b* within each vessel element 109 is not limited to those shown in FIGS. 16*a*-16*d*.

In one embodiment, a single vessel element 109 with its respective internal ballistic protection element(s) 111 and a containment system 110 compose at least one planar element 102*a* of the protective skin system 102, as shown in FIG. 16*a*

In one embodiment, multiple vessel elements 109 with their respective internal ballistic protection element(s) 111 and a containment system 110 compose at least one planar element 102*a* of the protective skin system 102, as shown in FIGS. 16*b* and 16*d*.

Containment System With Enclosure Element

Referring now to FIGS. 16*a*-16*d* and 20*a*-20*c*, there are shown axonometric views of an embodiment of the shelter system wherein the vessel element 109 is complemented by a containment system 110 comprising at least one enclosure element 110*a*. In a preferred embodiment, an enclosure element 110*a* is at least one more or less planar enclosure that is more or less oriented on the plane of an opening established by the vessel element sidewalls 109*a*. The enclosure element 110*a* is of an appropriate dimensional area to at least partially and at least temporarily seal at least one opening of at least one compartment 109*b* within at least one vessel element 109. In a preferred embodiment, the seal between the sidewalls 109*a* and each enclosure element 110*a* is of an appropriate tolerance to prevent the leaking or removal of the respective internal ballistic protection element(s) 111. In a preferred embodiment, at least one enclosure element 110*a* may be at least temporarily removed or opened to allow access to the compartment(s) 109*b*.

Referring now to FIGS. 16*a*-16*d*, there are shown axonometric views of embodiments of the protective skin system, wherein the vessel element sidewalls 109*a* comprise rigid materials; also, the containment system 110 further comprises at least two enclosure elements 110*a*. At least one enclosure element 110*a* seals the top opening(s) and at least one enclosure element 110*a* seals the bottom opening(s) of at least one compartment 109*b* of at least one vessel element 109.

In one embodiment, the enclosure elements 110*a* are temporarily fastened one to another, to sandwich the vessel element 109 in-between, as shown on the right side in FIGS. 16*a*-16*d*.

Referring again to FIGS. 16*a*-16*d*, there are shown axonometric views of embodiments of a vessel element embodiment wherein multiple pairing arrangement embodiments of vessel elements 109 and their respective containment elements are illustrated. These embodiments demonstrate variation in the number of vessel elements 109 per enclosure elements 110*a* and vice versa. The embodiments shown do not exhaust the ratios of vessel elements 109 to their respective containment systems 110. Referring again to FIGS. 16*a*-16*d*, there are shown axonometric views of vessel element embodiments on the left and other embodiments with the same vessel element at least partially sealed by its respective embodiment of the containment system on the right Two enclosure elements 110*a* are fastened to enclose at least one vessel element 109.

Enclosure Element With Flange Embodiment(s)

In one embodiment, the enclosure element 110*a* additionally comprises and is held in place by at least one flange 110*b* running orthogonally off of at least one of the enclosure element's 110*a* perimeter edges as shown in FIGS. 16*a*-16*d*. Depending on the number and location of the flanges 110*b*, said flanges 110*b* may be fastened to, be wedged with, contiguous with, formed with, and/or fastened into the inside surface of at least one sidewall 109*a*, or the outside surface of at least one sidewall 109*a* of the vessel element 109. In a further embodiment, there are an equal number of flanges 110*b* attached to each enclosure element 110*a* as there are perimeter sidewalls 109*a* in a single vessel element 109, as shown in FIGS. 16*a*, 16*c*, and 16*d* or contiguous plurality of vessel elements 109, as shown in FIG. 16*b*. Flanges 110*b* may be referred to as side-skirts 110*b* or containment side skirting 110*b*. An embodiment of the vessel element 109 with elongated compartments 109*b* and an embodiment of the enclosure element 110*a* with side skirting and fastening is illustrated in FIG. 16*d*.

In one embodiment, a plurality of vessel elements 109 are enclosed by at least two enclosure elements 110*a*, as shown in FIG. 16*b*.

In one embodiment, each individual vessel element 109 is enclosed by at least two enclosure elements 110*a*, as shown in FIG. 16*d*.

In one embodiment, each individual vessel element 109 compartment 109*b* is enclosed by at least two enclosure elements 110*a*, as shown on the far right side in FIG. 16*d*.

Methods for Securing Enclosure Elements

Referring again to FIGS. 16*a*-16*d*, there are shown axonometric views of embodiments the containment system 110 demonstrating additional embodiments for securing the enclosure element 110*a*. Methods for securing each enclosure element 110*a* include but are not limited to cable, draw cord, cinch, strap, hinge and/or clasping hardware, sewing, zippering, velcro-type bond, and tape fastenings.

Permanent Enclosure Element Embodiment(s)

In one embodiment, at least one enclosure element 110*a* is permanently attached to, or formed with the perimeter sidewalls 109*a* of at least one compartment 109*b* to provide permanent containment for at least one compartment 109*b* opening; at least one other enclosure element 110*a* provides at least temporary access to the compartment 109*b* opening, as shown in FIGS. 19*b*-19*g* and 20*a*-20*b*.

Non-Rigid Vessel Element Embodiment(s)

Referring now to FIGS. 9*b*-19*g* and 20*a*-20*c*, there are shown diagrammatic section views and axonometric views of a preferred embodiment of the protective skin system 102 wherein the vessel element 109 comprises non-rigid materials.

In one embodiment of the protective skin system 102, the containment system 110 of the vessel element 109 further comprises at least one enclosure element 110*a* that is sewn to the sidewalls 109*a* and/or is of the same seamless piece of material as at least one of the sidewalls 109*a* of the compartment(s) 109*b* within the vessel element 109, as shown in FIGS. 9*b*-19*g* and 20*a*-20*b*; access to the compartment 109*b* is provided at at least one opening for each compartment 109*b*.

In one embodiment of the protective skin system 102, the containment system 110 of the vessel element 109 further comprises at least one drawstring 110*c* activated enclosure element 110*a* that at least partially seals at least one compartment 109*b* opening when constricted and provides an access point for the insertion of the internal ballistic protection element 111 into the compartment 109*b* when expanded, as shown in FIGS. 19*b*-19*g* and 20*a*-20*b*. In an alternate embodiment for the provision of an access point for the vessel element 109 compartment 109*b*, the enclosure element 110*a* at least in part comprises an elastic type seal that expands and constricts in a similar manner and role as the drawstring activated enclosure element 110*a*.

In one embodiment of the protective skin system 102, the containment system 110 of the vessel element 109 further comprises an additional enclosure element 110*d* on at least one face of the planar element 102*a*; this additional enclosure element 110*d* may cover all compartment 109*b* openings of the planar element 102*a* on said face, as shown in FIG. 20*d*. Multiple enclosure elements 110*a* may be disposed per compartment 109*b* opening. The planar element 102*a*, including the enclosure element 110*a*, may serve the additional role of protecting the vessel element 109 from the natural elements.

Double Layer of Planar Element Embodiment(s)

Referring now to FIG. 8*d*, there is shown an elevation view of one embodiment of the shelter system wherein one side plane of the protective skin system 102 includes at least two layers of planar elements 102*a*. The multiple layers may assist in providing protection at the sidewall 109*a* seams of compartments 109*b* within a vessel element 109 and/or seams between vessel elements 109.

Figure 6B:
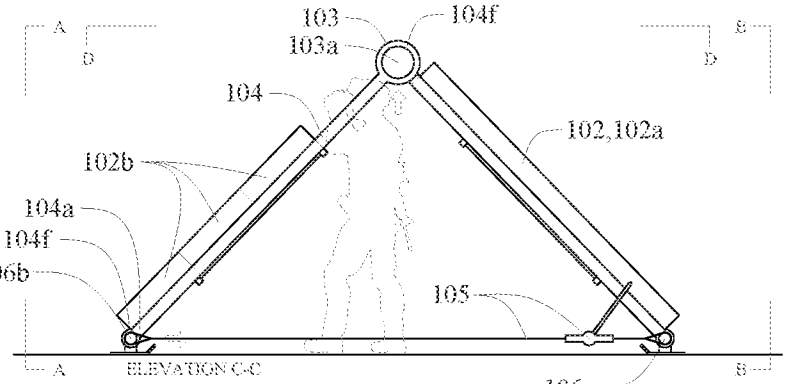
FIG. 6*b* is an elevation view of one embodiment of the shelter system wherein the planar elements of the protective skin system comprise a composition of adjacent masses.
Figure 6A:
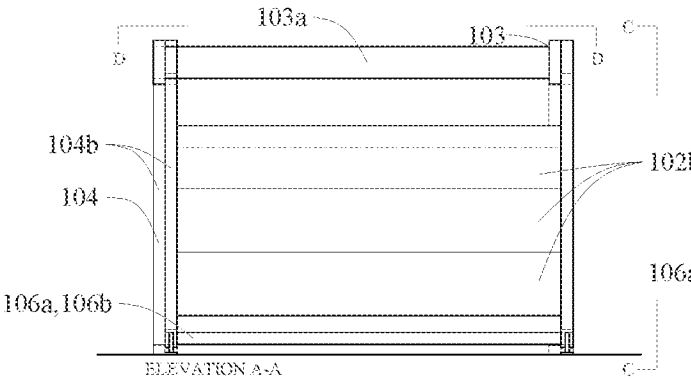
FIG. 6*a* is an elevation view of one embodiment of the shelter system wherein the planar element of the protective skin system comprises a composition of adjacent masses.
Figure 6D:
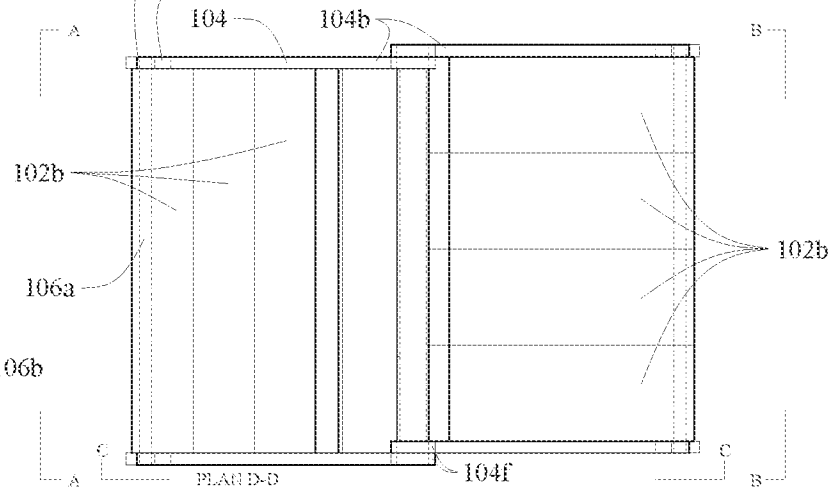
FIG. 6*d* is a plan view of one embodiment of the shelter system wherein the planar elements of the protective skin system comprise a composition of adjacent masses.
Figure 6C:
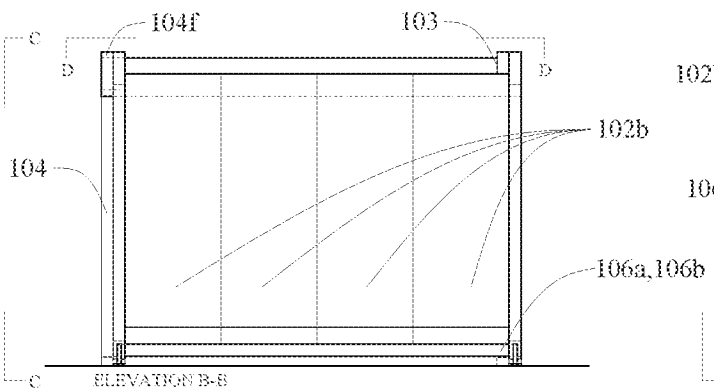
FIG. 6*c* is an elevation view of one embodiment of the shelter system wherein the planar element of the protective skin system comprises a composition of adjacent masses.

In one embodiment, the planar elements 102*a* do not necessarily occupy the entire side plane of the erecting frame system 101, as shown in FIGS. 6*b* and 8*d*.

In one embodiment, the compartments 109*b* within each layer are of different dimensions, as shown in FIG. 8*d*.

Tethering Element Embodiment(s)

In one embodiment, the protective skin system 102 further comprises at least one tethering element 109*c*; the tethering element 109*c* is a component that at least partially suspends or secures the protective skin system 102 on the erecting frame system 101 by connecting at least two planar elements 102*a* wherein each of said planar elements 102*a* occupies a different plane.

Figure 8C:
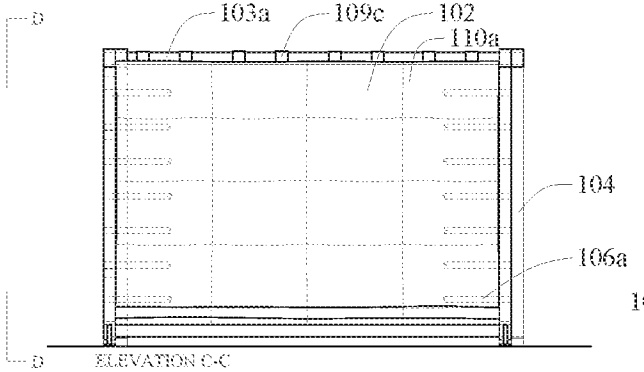
FIG. 8*c* is an elevation view of one embodiment of the shelter system wherein the protective skin system comprises at least one non-rigid vessel element.

In one embodiment, the protective skin system 102 is at least in part suspended by and/or secured in place by at least one tethering element 109*c* that straddles a central member 103*c* or axle as shown in FIGS. 8*c*-8*d*.

Vessel Element as A-Frame Leg Embodiment(s)

Figure 10:
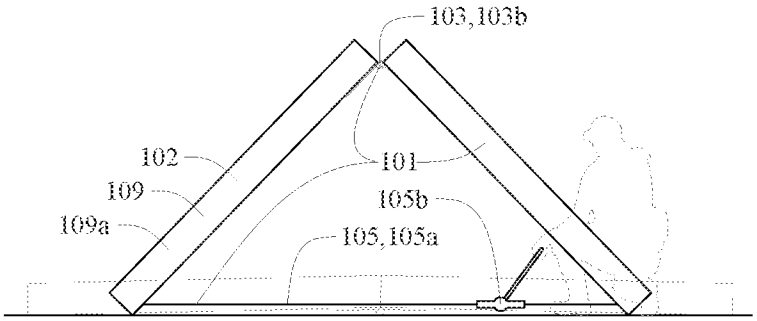
FIG. 10 is an elevation view of one embodiment of the shelter system wherein a rigid protective skin system satisfies the role of an A-frame leg.

Referring now to FIG. 10, there is shown an alternate embodiment of the protective skin system 102 wherein the vessel element 109 is rigid in construction and serves the same role as and is therefore substantially the same component as the A-frame leg 104 component.

The embodiments of vessel element 109 and enclosure systems 110*a* described and illustrated may be used in combination with one another and/or with alternate methods of containing and sealing of the internal ballistic protection element 111 not explicitly detailed in this description. The embodiments of vessel element 109 and enclosure systems 110*a* described and illustrated together may be used independently of one another within the overall shelter system.

The Internal Ballistic Protection Element

The internal ballistic protection element 111 is at least one object, of any material, that partially or fully fills a compartment 109*b* of a vessel element 109, and is capable of mitigating a relevant ballistic threat, as shown in FIGS. 16*b*-16*d*, 17*a*-17*d*, 18*a*-18*c*, 19*a*-19*g*, 20*a*-20*c*, and 21*a*-21*g*; the internal ballistic protection element 111 is an integral element to those embodiments of the protective skin system that at least in part utilize at least one vessel element 109.

In one embodiment of the protective skin system 102, the internal ballistic protection element 111 comprises synthetic elements, such as composite or homogenous plates, blocking or spacer elements, fabrics, fiber plastics, fiber composites, ceramics, particle fill or any combination thereof. FIGS. 18*a*-18*c* illustrate one embodiment of the protective skin system wherein the internal ballistic protection element 111 comprises compartment plates 111*b* with spacing elements 111*g* and volume displacing objects 111*h*.

In one embodiment of the protective skin system 102, the internal ballistic protection element 111 comprises naturally occurring organic and/or mineral elements, in the form of blocking elements, and/or particle fill 111*a*. FIGS. 17*a*-17*d* illustrate one embodiment of the protective skin system wherein the internal ballistic protection element 111 comprises particle fill 111*a*.

In one embodiment of the protective skin system 102, the internal ballistic protection element 111 comprises some combination of synthetic and naturally occurring elements. FIGS. 19*b*-19*g* and 21*a*-21*g* illustrate two embodiments of the protective skin system wherein the internal ballistic protection element 111 comprises particle fill 111*a* and compartment plates 111*b*.

Particle Fill Based Embodiment(s)

Referring now to FIGS. 17*a*-17*d*, there is shown section views of one embodiment of the shelter system wherein the internal ballistic protection element 111 at least in part comprises particle fill 111*a*. The particle fill 111*a* may comprise naturally occurring elements or synthetic elements; in an alternate embodiment, the particle fill 111*a* comprises some combination of naturally occurring elements and synthetic elements.

Moisture and Cementitious Additive Embodiment(s)

In one embodiment, moisture and/or a cementitious additive is added to the particle fill 111*a* during the placement of the particle fill 111*a* within the compartment 109*b*.

Compacted Particle Fill Embodiment(s)

In a preferred embodiment, the internal ballistic protection element 111 comprises particle fill 111*a* that has been compacted. Compaction increases density and consequently improves the ballistic protection performance per volume of the compartment 109*b*. A more or less measured compaction process may be utilized to establish a more uniform density of compacted particle fill 111*a* among multiple vessel element 109 compartments 109*b*. The plurality of vessel element compartments 109*b* combined with the compaction process may assist with preventing settlement and uneven levels of protection within the protective skin system 102.

The increase in relative density of the internal ballistic protection element 111 resulting from the compaction of particle fill 111*a* inherently improves the ballistic protection performance of the protective skin system 102; however, it also makes the protective skin system 102 heavier per its unit volume. As discussed earlier, this relationship makes the compacted particle fill based embodiments of the protective skin system 102 well suited for pairing with the erecting frame system 101, as shown in FIGS. 21*a*-21*g*.

Figure 21E:
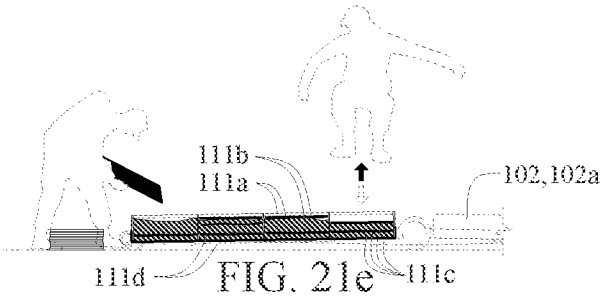
FIG. 21*e* is a diagrammatic section view of a filling process used to establish strata within a vessel element compartment in one embodiment of the protective skin system. additional plates and particle being added and forces applied to compact the particle fill.
Figure 21F:
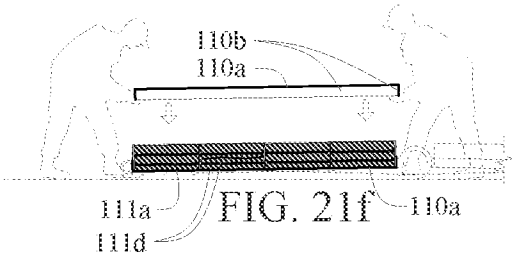
FIG. 21*f* is a diagrammatic section view of a filling process used to establish strata within a vessel element compartment in one embodiment of the protective skin system.
Figure 21G:
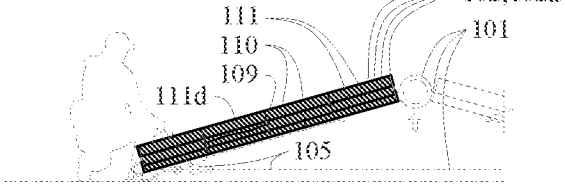
FIG. 21*g* is a diagrammatic section view of a filling process used to establish strata within a vessel element compartment in one embodiment of the protective skin system.
Figure 21A:
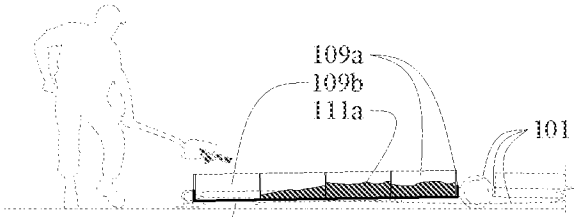
FIG. 21*a* is a diagrammatic section view of an assembly process used in one embodiment of the protective skin system, particle fill being added to the compartments.
Figure 21B:
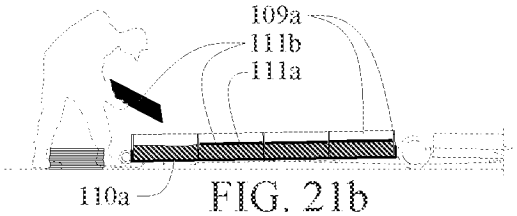
FIG. 21*b* is a diagrammatic section view of an assembly process used in one embodiment of the protective skin system, compartment plates placed atop the particle fill within the compartments.
Figure 21C:
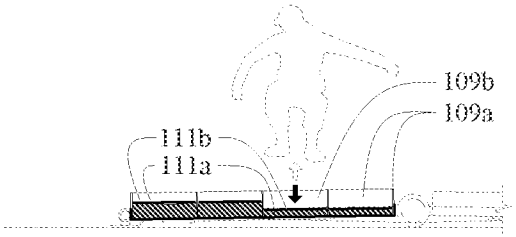
FIG. 21*c* is a diagrammatic section view of an assembly process used in one embodiment of the protective skin system, a force is being applied to the compartment plate to compact the particle fill below.

In one embodiment, the internal ballistic protection element 111 further comprises a combination of particle fill 111*a* and at least one compartment plate 111*b*. The compartment plate 111*b* may be used for the compaction of the particle fill 111*a* below, as shown in FIG. 21*c*. The face perimeter of said compartment plate 111*b* should be similar in shape to the interior perimeter of the vessel element sidewalls 109*a* when viewed in plan; the interior perimeter of the vessel element sidewalls 109*a* should be of a slightly larger area than that of the face area of the compartment plate 111*b*, thereby allowing the compartment 109*b* to receive at least one compartment plate 111*b*. In a preferred embodiment, at least one individual or piece of equipment at least temporarily applies a force to the compartment plate 111*b* that is positioned above at least one layer of particle fill 111*a* within at least one compartment 109*b*. This force may be referred to as a compactive force. In this embodiment, the compartment plate 111*b* is rigid, thereby facilitating the distribution of the compactive force(s) to approximately the entire area of a compartment 109*b* when viewed in plan. This compactive force is more or less maximized if the vessel element 109 is laying more or less flat on the ground surface.

In one embodiment, the force of at least one individual repetitively jumping upon compartment plate 111*b* that is located above the particle fill 111*a* within the compartment 109*b* results in the compaction of at least one layer of particle fill 111*a*

Compartment Plate Used for Compaction

In one embodiment, the compartment plate 111*b* may be removed following the fill and compaction process so that the internal ballistic protection element 111 primarily comprises compacted particle fill 111*a*.

Replacement With or Addition of Ballistic Armor Insert

Figure 21D:
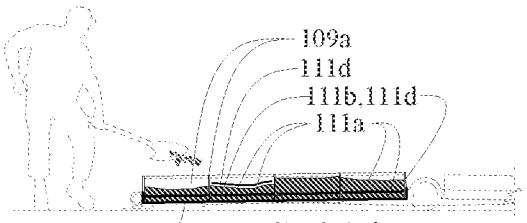
FIG. 21*d* is a diagrammatic section view of a filling process used to establish strata within a vessel element compartment in one embodiment of the protective skin system, additional particle fill being added to the compartment and a non-rigid ballistic armor insert placed within a compartment.

In an alternate embodiment of the internal ballistic protection element 111, at least one ballistic armor insert 111*d* is deposited with, or in place of, the compartment plate 111*b* used for compaction; in this embodiment, one plate is primarily used for compaction and the additional ballistic armor insert 111*d* is primarily used to increase ballistic protection, as shown in FIG. 21*d*. The ballistic armor insert 111*d* may take the form of, but is not limited to that of rigid armored plate(s), panel(s), and/or non-rigid or semi-rigid layer(s) of ballistic resistant material that serve the role of increasing ballistic protection.

Compartment Plate Used for Compaction and Ballistic Protection

In a preferred embodiment, the compartment plate 111*b* may remain in the compartment 109*b* to serve the additional role of increasing ballistic protection performance of the protective skin system 102, as shown in FIGS. 19*b*-19*g* and 21*a*-21*g*. When serving the role of increasing ballistic protection, the compartment plate 111*b* may also be referred to as a ballistic armor insert 111*d*.

Strata Embodiment(s)

In a preferred embodiment, the internal ballistic protection element 111 further comprises a plurality of alternating layers of particle fill 111*a* and/or ballistic armor inserts 111*d*, as shown in FIGS. 19*a*-19*g* and 21*a*-21*g*; said plurality of alternating layers may be referred to as strata 111*c*. In a preferred embodiment of the strata-based internal ballistic protection element 111, at least one layer of particle fill 111*a* in the strata 111*c* is compacted. The establishment of this strata-based embodiment of the protective skin system 102 is illustrated in FIGS. 21*a*-21*g* and outlined in the following description of said figures.

Referring again to FIGS. 21*a*-21*g*, there are shown diagrammatic section views of sequential steps in the filling process used to establish strata 111*c* within a compartment 109*b* in one embodiment of the protective skin system. Referring now to FIG. 21*a*, particle fill 111*a* is being added to the compartments 109*b*; referring now to FIG. 21*b*, compartment plates 111*b* are being added to the compartments 109*b* and placed above the layer of particle fill 111*a*; referring now to FIG. 21*c*, a compactive force is being applied to the compartment plates 111*b* to compact the layer of particle fill 111*a* below; referring now to FIG. 21*d*, particle fill 111*a* is being added to the compartments 109*b* above the previous compacted layer of particle fill 111*a* and compartment plate 111*b*, with said compartment plate also serving the role of a ballistic armor insert 111*d*; referring again to FIG. 21*d*, a non-rigid or semi-rigid ballistic armor insert 111*d* has also been added to one compartment 109*b*; referring now to FIG. 21*e*, a compactive force is again applied to the compartment plates 111*b* to compact the layer(s) of particle fill 111*a* below; referring now to FIG. 21*f*, an enclosure element 110*a* is placed to seal the vessel element 109 once strata 111*c* have been established within the compartment(s) 109*b*; referring now to FIG. 21*g*, a planar element 102*a* of the protective skin system 102 is in the initial stages of being repositioned by the erecting frame system 101.

This strata 111*c* arrangement is advantageous for ballistic protection performance in that it induces the deformation of ballistic threats and it absorbs at least part of the kinetic energy of the ballistic threat as the ballistic threat proceeds through successive layers of ballistic armor insert 111*d* and particle fill 111*a*

Non-Rigid Sidewall With Rigid Form Embodiment(s)

Referring now to FIGS. 19*b*-19*g*, there are shown section views of one embodiment of the shelter system wherein the vessel element 109 of the protective skin system 102 at least in part comprises non-rigid, and/or semi-rigid sidewalls 111*f*. Due to the non-rigid quality of the sidewalls 109*a*, a rigid form 111*e* may be at least temporarily inserted into a compartment 109*b* to improve the efficiency of the compaction process and to form the compacted particle fill 111*a* into the prescribed shape of the compartment 109*b*. The rigid form 111*e* comprises a plurality of rigid sidewalls 111*f* with a top and bottom opening. In its preferred embodiment, when viewed in plan, the rigid form 111*e* may be more or less similar in shape and dimension to the perimeter of the interior sidewalls 109*a* of a vessel element compartment 109*b*; the area established by the interior perimeter of the rigid sidewalls 111*f* of the rigid form 111*e* is slightly larger than the area created by the outer perimeter of the compartment plate 111*b* used for compaction, thereby allowing the rigid form 111*e* to receive at least one compartment plate 111*b*. In a preferred embodiment, the rigid form 111*e* is removed from the compartment 109*b* following the filling and compaction steps; in this embodiment, the height of the rigid sidewalls 111*f* may be greater than that of the sidewalls 109*a* of the vessel element 109 to allow for easier removal of the rigid form 111*e* from the compartment 109*b*. In an alternate embodiment, the rigid form 111*e* remains within a compartment 109*b* following the filling and compaction steps; in this embodiment, the height of the rigid sidewalls 111*f* may be more or less equal to that of the sidewalls 109*a* of the vessel element 109. The establishment of strata 111*c* within a non-rigid vessel element embodiment is in part illustrated in FIGS. 19*b*-19*g* and outlined in the following description of said figures.

Referring again to FIGS. 19*b*-19*g*, there are shown diagrammatic section views of sequential steps in the filling process used to establish strata 111*c* within a compartment 109*b* in a non-rigid vessel element embodiment of the protective skin system 102. Referring now to FIG. 19*b*, an empty vessel element 109 and containment system 110 are in a partially slackened state; referring now to FIG. 19*c*, an empty vessel element 109 and containment system 110 are spread out and ready to receive a rigid form 111*e*; a drawstring 110*c* of the enclosure element 110*a* has been almost completely loosened and a compartment plate 111*b* is resting within the compartment 109*b* and upon the bottom enclosure element 110*a*; referring now to FIG. 19*d*, the rigid form 111*e* has been inserted within the compartment 109*b*, has been partially filled with particle fill 111*a*, and an additional compartment plate 111*b* is positioned to be placed on top of said particle fill 111*a*; referring now to FIG. 19*e*, the rigid form within the compartment 109*b* has been partially filled with particle fill 111*a* and an additional compartment plate 111*b* has been placed on top of said particle fill 111*a*; a compactive force is being applied to the compartment plate 111*b* in an effort to compact the particle fill 111*a* below; referring now to FIG. 19*f*, the rigid form 111*e* within the compartment 109*b* is being removed following the establishment strata 111*c* within the compartment 109*b*; referring now to FIG. 19*g*, the drawstring 110*c* of the enclosure element 110*a* has been cinched tight in order to at least partially seal the compartment 109*b* opening with the top compartment plate 111*b*. The compartment plate 111*b* is also serving the role of ballistic armor insert 111*d* in the preceding description.

Thwart Element Embodiment(s)

Referring now to FIGS. 7*a*-7*b*, there are shown elevation views of one embodiment of the shelter system wherein the planar elements of the protective skin system 102 at least in part is non-rigid, semi-rigid, and/or segmented in form and the erecting frame system further comprises a thwart element 104*a*. Said thwart element 104*a* is at least one elongated structural member that is positioned during the erecting process such that it makes contact with at least two planar elements 102*a* of the protective skin system 102 and provides a thrust force on said at least two planar elements as the A-frame leg feet 104*a* are drawn together by the tensioning element 105. The thwart element 104*a* may prevent sagging of the associated planar elements 102*a* that it comes in contact with and provide additional protected volume within the shelter system.

Non Compacted Particle Fill With Ballistic Armor Insert Embodiment(s)

In one embodiment, at least one layer of particle fill 111*a* and at least one ballistic armor insert 111*d* is established within the compartment 109*b* without any distinct compaction effort made on the particle fill 111*a*.

Non Compacted Particle Fill Embodiment(s)

Referring now to FIGS. 17*a*-17*d*, particle fill 111*a* alone is added to at least one compartment 109*b* without a compartment plate 111*b* component and without a prescribed compaction process. The particle fill 111*a* may be natural, synthetic, or a combination thereof.

Foxhole Embodiment(s)

In one embodiment of the shelter system, a 'fox hole' or other form of entrenchment is dug in conjunction with the displacement of natural particle fill 111*a* required in a particle fill based embodiment of the protective skin system 102, as shown in FIG. 8*d*.

Non-Particle Fill Based Embodiments

Referring now to FIGS. 18*a*-18*c*, there are shown elevation views of an alternate embodiment of the protective skin system 102 wherein the internal ballistic protection element 111 of a vessel element based protective skin system comprises at least one ballistic armor insert 111*d*. At least one ballistic armor insert 111*d* is placed into a compartment 109*b* and occupies at least a portion of the internal volume thereof.

In a preferred embodiment of the ballistic armor insert 111*d*, the outer perimeter of said ballistic armor insert 111*d* is roughly similar in shape and dimension to that of the interior perimeter of the sidewalls 109*a* of a compartment 109*b*.

In one embodiment, the internal ballistic protection element 111 comprises a spaced armor arrangement; that is to say, multiple ballistic armor inserts 111*d* are offset from one another either by a void space and/or by a volume displacing object 111*h* or group of objects. A volume displacing object 111*h* may also be referred to as a spacing element 111*g*. A ballistic threat and its path will deform and at least partially lose kinetic energy as the ballistic threat passes through the ballistic armor inserts 111*d* in series. When in this spaced arrangement, the said multiple ballistic armor inserts 111*d*, being offset from one another, may be collectively referred to as a spaced armor insert 111*i*.

In one embodiment, the form and composition of the spacing element 111*g* may include but are not limited to: orthogonally-aligned-rods and/or interstitial-framing of any form, shape and arrangement, that making contact with at least two ballistic armor inserts 111*d*, provides the offset between said ballistic armor inserts 111*d*, as shown in FIG. 18*a*.

An embodiment demonstrating the establishment of the spaced armor insert 111*i* within the compartment 109*b* of a vessel element 109 is in part illustrated in FIGS. 18*a*-18*c* and outlined in the following description of the figures.

Referring again to FIGS. 18*a*-18*c*, there are shown diagrammatic section views of assembly process in the establishment of a spaced armor insert 111*i* within the compartments 109*b* of a vessel element based embodiment of the protective skin system 102. Referring now to FIG. 18*a*, a spaced armor insert 111*i* is being placed within an empty compartment 109*b*; referring now to FIG. 18*b*, a spaced armor insert 111*i* has been placed within each compartment 109*b* of the vessel element 109 and an enclosure surface is being positioned to seal the vessel element 109; referring now to FIG. 18*c*, the vessel element 109 of the protective skin system 102 is supported by, and is in the initial stages of being repositioned by, the erecting frame system 101.

In one embodiment, the internal ballistic protection element 111 comprises synthetic elements. Typical synthetic elements used for ballistic protection may include but are not limited to: composite or homogenous plates, blocking or spacer elements, fabrics, fiber plastics, fiber composites, ceramics, or any combination thereof.

Non Vessel Based Conventional Armor Embodiment(s)

Figure 15B:
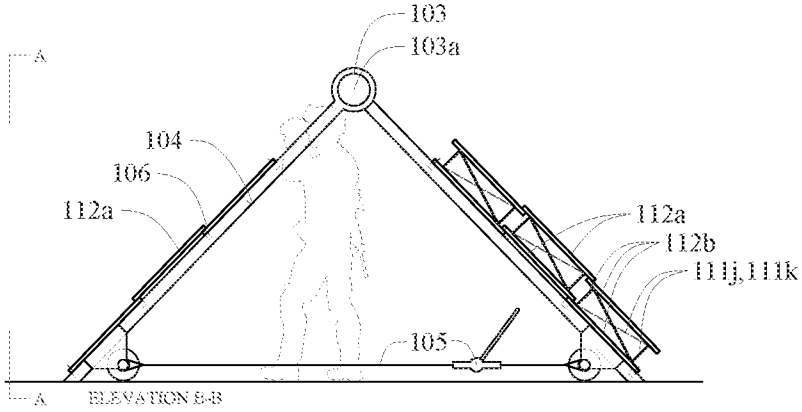
FIG. 15*b* is an elevation view of one embodiment of the shelter system wherein two potential embodiments of the protective skin system are shown.
Figure 15A:
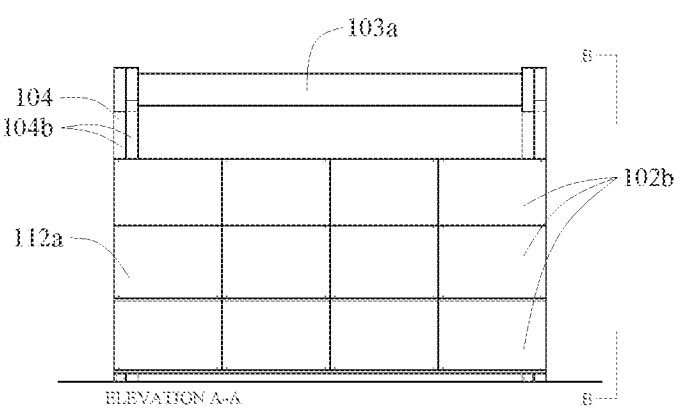
FIG. 15*a* is an elevation view of one embodiment of the shelter system wherein the protective skin system primarily comprises a conglomerate of armor plates attached to the erecting frame system.

Referring now to FIGS. 15*a*-15*b*, there are shown elevation views of two embodiments of the protective skin system wherein the planar element 102*a* comprises at least one armor plate. Said armor plate 112*a* is similar in description to the ballistic armor insert 111*d*, save that it does not necessarily involve the insertion of the armor plate 112*a* within the compartment of a vessel element.

Referring now to FIG. 15*b*, two potential embodiments of the armor plate based protective skin system 102 are illustrated. On the side plane to the left, the protective skin system 102 primarily comprises a plurality of armored plates 112*a* more or less arranged concordantly to one another to form a planar element 102*a*. On the side plane to the right, the protective skin system 102 primarily comprises a plurality of spaced armor assemblies 112*b* more or less arranged concordantly to one another to form a planar element 102*a*. This alternate embodiment of the armored plate based system comprises at least one spaced armor assembly 112*b*. The spaced armor assembly 112*b* comprises at least two layers of armored plates 112*a* being offset one from another by a spacing element 111*g*, As such, said spaced armor assembly 112*b* is similar in description to the spaced armor insert, save that it does not necessarily involve the insertion of the spaced armor assembly 112*b* within the compartment of a vessel element. The planar elements 102*a* of both armor plate based embodiments of the protective skin system 102 illustrated in FIGS. 15*a*-15*b* are at least in part supported by and/or affixed to the erecting A-frame structure.

The composition of armor plates 112*a*, ballistic armor inserts 111*d*, spaced armor assemblies 112*b*, and spaced armor inserts 111*i* may include, but is not limited to, hardened steel, composite ceramic armor, fiber plastics, fiber composites, metal alloy, synthetic fibers, and/or other manufactured armor systems, or some combination thereof.

One advantage of employing the erecting frame system 101 with the armor plate based embodiments of the protective skin system is that the individual armor plates 112*a* and/or spaced armor assemblies 112*b*, being lighter pieces of a heavier conglomerate, may be efficiently stored, transported and then assembled on the more or less flat erecting frame system 101. The erecting frame system 101 facilitates the lifting of the heavier conglomerate of armor plates 112*a* and/or spaced armor assemblies 112*b* in to a functional barrier via the mechanical advantage associated with the tension force used to draw the A-frame leg feet 104*a* towards one another.

End and Roof Protection Embodiment(s)

In one embodiment, the protective skin system 102 comprises at least one end protection planar element 102*c*. Referring now to FIGS. 14*a*-14*b*, the end protection planar element 102*c* occupies the plane more or less concordant with and/or at least partially occupying an end plane. The end protection planar elements 102*c* may more or less take the form of a triangular, rhomboid, or other appropriate shape, as a single element or as a composition of elements, which in all other characteristics outside of shape and dimension, is/are similar in nature and in construction to the protective skin system embodiments hereinabove described. In embodiments of the erecting frame system comprising at least one lateral leg 106*c*, the end plane of the erecting frame system 101 may be further defined as a plane more or less concordant with and/or occupying the plane between at least one A-frame leg 104, at least one lateral leg 106*c*, and the ground surface.

In a similar manner, referring now to FIG. 12*b*, the protective skin system 102 of those embodiments that at least in part comprise a protective roof structure 108 and roof protection planar element 102*d* may more or less take the form and appropriate shape similar to the perimeter of the protective roof structure 108 when viewed in plan; the roof protection planar element 102*d* may comprise a single element or a composition of elements, which in all other characteristics outside of shape and dimension, is/are similar in nature and in construction to the protective skin system embodiments hereinabove described.

Modularity

Multiple sets of erecting frame systems 101 and their respective protective skin systems 102 may be arranged in a modular fashion in order to create a larger contiguous protected volume. In one modular arrangement embodiment, the erecting frame systems are arranged more or less end plane to end plane.

The headings of this description are for convenience only and shall not be used to interpret or construe the contents of the description.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A shelter system comprising:

a) an erecting frame system comprising: at least two primary A-frame legs and at least one tensioning element, the primary A-frame legs each comprising:

at least one elongated structural member, each of the primary A-frame legs coalescing with at least one other A-frame leg with at least one connection, the at least one tensioning element being at least temporarily affixed to a free end of each of the at least two primary A-frame legs, the at least one tensioning element comprising at least one substantially elongated structural element capable of generating a tension force to draw the free ends of the at least two primary A-frame legs towards one another, thereby at least temporarily lifting the at least one connection to a predetermined height above the free end of each primary A-frame leg; and b) a protective skin system comprising: at least one planar element occupying at least one plane selected from a group of planes consisting of: a side plane, a roof plane, and an end plane, the side plane disposed between the two primary A-frame legs, the roof plane being concordant with a ground surface and of a similar elevation above the ground surface as the at least one connection of at least two A-frame legs, and the end plane disposed between the two primary A-frame legs of a constituent A-frame leg pair and the ground surface, the at least one planar element of the protective skin system providing at least a partial barrier from a ballistic threat to a volume behind the at least one planar element, the loading of the protective skin system being transferred at least in part first to the erecting frame system and ultimately to the ground surface;

wherein the erecting frame system further comprises at least two offset and parallel pairs of primary A-frame legs and at least one cylindrical axle and wherein an upper portion of each primary A-frame leg has at least one circular opening that functions as a bearing for the at least one cylindrical axle, the at least one cylindrical axle and the at least one circular opening forming a connection, the at least one cylindrical axle extending between the at least two pairs of primary A-frame legs; and wherein the at least one cylindrical axle is at least partially hollow and capable of containing liquid fill, and the at least one cylindrical axle being capable of receiving and distributing liquid fill, the at least one cylindrical axle being filled with the liquid while the at least one cylindrical axle is proximate the ground surface so that, as the primary A-frame legs are drawn together via the at least one tensioning element, and the at least one cylindrical axle is raised off of the ground surface, a relative pressure head is established to facilitate a source of pressurized liquid for use in at least a protected volume therein below.

2. The shelter system of claim 1, wherein the erecting frame system further comprises at least two offset pairs of A-frame legs and at least one central member, the central member extending from a point of coalescence of two A-frame legs in a pair to a point of coalescence of two A-frame legs in at least one other pair of A-frame legs.

3. The shelter system of claim 1, further comprising at least one skid component at least temporarily fastened to the free end of at least one A-frame leg in order to reduce friction between the ground surface and the erecting frame system during a tensioning process.

4. The shelter system of claim 1, further comprising at least one wheel component at least temporarily fastened to the free end of each A-frame leg in order to reduce friction between the ground surface and the erecting frame system during a tensioning process.

5. The shelter system of claim 1, further comprising lateral bracing comprising at least one lateral member disposed substantially orthogonally from one A-frame leg within a pair of A-frame legs to at least one other A-frame leg of another pair of A-frame legs.

6. The shelter system of claim 1, further comprising at least two additional A-frame legs with respective tensioning elements, and with a hinge type connection, at least temporarily affixed to the free end of each A-frame leg within the at least two pairs of primary A-frame legs, the additional A-frame legs serving to raise the shelter system off the ground surface by drawing free ends of each additional A-frame legs together with at least one of the tensioning elements.

7. The shelter system of claim 1, further comprising a protective roof structure; the protective roof structure comprising a plurality of rafter elements and a plurality of purlin elements, the plurality of rafter elements extending laterally from and supported by the at least one cylindrical axle, the plurality of purlin elements extending laterally from and supported by at least two offset rafter elements of the plurality of rafter elements, the protective skin system at least partially occupying the roof plane, the roof plane being established by the plurality of rafter elements and the plurality of purlin elements.

8. A shelter system comprising:

a) an erecting frame system comprising: at least two A-frame legs and at least one tensioning element, the A-frame legs each comprising:

at least one elongated structural member, each of the A-frame legs coalescing with at least one other A-frame leg with at least one connection, the at least one tensioning element being at least temporarily affixed to a free end of each of the at least two A-frame legs, the at least one tensioning element comprising at least one substantially elongated structural element capable of generating a tension force to draw the free ends of the at least two A-frame legs towards one another, thereby at least temporarily lifting the at least one connection to a predetermined height above the free end of each A-frame leg; and b) a protective skin system comprising at least one planar element from a group of planes consisting of: a side plane, a roof plane, and an end plane, the side plane disposed between the two A-frame legs, the roof plane being concordant with a ground surface and of a similar elevation above the ground surface as the at least one connection point of the at least two A-frame legs, and the end plane disposed between the at least two A-frame legs of a constituent A-frame leg pair and the ground surface, the at least one planar element of the protective skin system providing at minimum protection from shrapnel from indirect fire to a volume behind the at least one planar element, the loading of the protective skin system being transferred at least in part first to the erecting frame system and ultimately to the ground surface;

wherein the at least one planar element comprises:

at least one vessel element, constructed of fabric, the at least one vessel element comprising a plurality of sidewalls, each sidewall being attached to at least two other sidewalls, an outer perimeter of the attached sidewalls forming at least one closed shape and establishing an internal compartment;

a containment system, constructed of fabric, the containment system comprising at least two planar enclosure elements, each planar enclosure element being oriented on a plane of at least one opening established by the sidewalls of the at least one vessel, each planar enclosure element at least partially sealing the at least one opening of the internal compartment within the at least one vessel, each opening of the at least one opening of each internal compartment being at least partially and at least temporarily sealed by at least one enclosure element; and at least one internal ballistic protection element comprising at least one object that occupies and at least partially fills the internal compartment of the at least one vessel element for providing at minimum protection from shrapnel from indirect fire, the at least one vessel element receiving its respective internal protection element for assembly while the erecting frame system is in a relatively flat arrangement at the ground surface.

9. The shelter system of claim 8, wherein the at least one internal ballistic protection element at least partially comprises particle fill, the particle fill being inserted into and compacted within the internal compartment while the erecting frame system is in a relatively flat arrangement at the ground surface.

10. The shelter system of claim 9, wherein the at least one internal ballistic protection element further comprises at least one compartment plate in addition to at least one layer of the particle fill, an opening in the internal compartment being larger than a face area of the at least one compartment plate, the at least one compartment plate being oriented on a plane concordant to that of the at least one opening of the internal compartment, the particle fill being positioned within the internal compartment between at least one compartment plate and the protected volume behind the protective skin system.

11. The shelter system of claim 9, further comprising at least one ballistic armor insert in addition to at least one layer of the particle fill; the at least one ballistic armor insert at least partially comprising fiber materials.

12. The shelter system of claim 9, wherein the at least one internal ballistic protection element further comprises at least one form that is at least temporarily inserted into the at least one internal compartment to aid in compaction of the particle fill, the outer perimeter of the plurality of sidewalls being slightly less than an interior perimeter of the at least one opening of the at least one internal compartment, the plurality of sidewalls being capable of providing resistance to lateral forces during compaction of the particle fill; the resistance provided by the plurality of sidewalls being greater than the resistance provided by the plurality of sidewalls of the at least one vessel.

13. The shelter system of claim 8, wherein at least one sidewall and at least one containment element of the at least one vessel element are at least part of the same piece of fabric.

14. The shelter system of claim 8, wherein the erecting frame system further comprises at least two offset and parallel pairs of A-frame legs and at least one cylindrical axle and wherein an upper portion of each A-frame leg has at least one circular opening that functions as a bearing for the at least one cylindrical axle, the at least one cylindrical axle and the at least one circular opening forming a connection, the at least one cylindrical axle extending between the at least two parallel pairs of A-frame legs.

15. The shelter system of claim 14, further comprising a protective roof structure; the protective roof structure comprising a plurality of rafter elements and a plurality of purlin elements, the plurality of rafter elements extending laterally from and supported by an axle, the plurality of purlins extending laterally from and supported by at least two offset rafter elements of the plurality of rafter elements, the protective skin system at least partially occupying the roof plane, the roof plane being established by the plurality of rafter elements and the plurality of purlin elements.

16. The shelter system of claim 8, wherein the erecting frame system further comprises at least two offset pairs of A-frame legs and at least one central member, the at least one central member extending from a point of coalescence of two A-frame legs in a pair of the at least two offset pairs of A-frame legs to a point of coalescence of two A-frame legs in at least one of an other pair of A-frame legs of the at least two offset pairs of A-frame legs.

17. A shelter system comprising a) an erecting frame system comprising:

i) at least two A-frame legs, ii) at least one tensioning element, the A-frame legs each comprising: at least one elongated structural member, each of the A-frame legs coalescing with at least one other A-frame leg with at least one connection, the at least one tensioning element being at least temporarily affixed to a free end of each of the at least two A-frame legs, the at least one tensioning element comprising at least one substantially elongated structural element capable of generating a tension force to draw the free ends of the at least two A-frame legs towards one another, thereby at least temporarily lifting the at least one connection to a predetermined height above the free end of each A-frame leg;

iii) a thwart element comprising at least one elongated structural member; and b) a protective skin system comprising at least one planar element from a group of planes consisting of: a side plane, a roof plane, and an end plane, the side plane disposed between the two A-frame legs, the roof plane being concordant with a ground surface and of a similar elevation above the ground surface as the at least one connection point of the at least two A-frame legs, and the end plane disposed between the at least two A-frame legs of a constituent A-frame leg pair and the ground surface, the at least one planar element of the protective skin system providing at minimum protection from shrapnel from indirect fire to a volume behind the at least one planar element, the loading of the protective skin system being transferred at least in part first to the erecting frame system and ultimately to the ground surface;

wherein each end of the thwart element being positioned to make contact with at least one planar element, thereby providing a lateral force on the at least one planar element as feet of the A-frame leg are drawn together by the at least one tensioning element and at least partially resisting any sagging of the at least one planar element.

18. A shelter system comprising a) an erecting frame system comprising:

i) at least two A-frame legs, ii) at least one tensioning element, the A-frame legs each comprising: at least one elongated structural member, each of the A-frame legs coalescing with at least one other A-frame leg with at least one connection, the at least one tensioning element being at least temporarily affixed to a free end of each of the at least two A-frame legs, the at least one tensioning element comprising at least one substantially elongated structural element capable of generating a tension force to draw the free ends of the at least two A-frame legs towards one another, thereby at least temporarily lifting the at least one connection to a predetermined height above the free end of each A-frame leg;

b) a protective skin system comprising at least one planar element from a group of planes consisting of: a side plane, a roof plane, and an end plane, the side plane disposed between the two A-frame legs, the roof plane being concordant with a ground surface and of a similar elevation above the ground surface as the at least one connection point of the at least two A-frame legs, and the end plane disposed between the at least two A-frame legs of a constituent A-frame leg pair and the ground surface, the at least one planar element of the protective skin system providing at minimum protection from shrapnel from indirect fire to a volume behind the at least one planar element, the loading of the protective skin system being transferred at least in part first to the erecting frame system and ultimately to the ground surface;

wherein the at least one planar element comprises:

at least one vessel element comprising a plurality of sidewalls, each sidewall being attached to at least two other sidewalls, an outer perimeter of the attached sidewalls forming at least one closed shape and establishing an internal compartment;

a containment system comprising at least two planar enclosure elements, each planar enclosure element being oriented on a plane of at least one opening established by the sidewalls of the at least one vessel, each planar enclosure element at least partially sealing the at least one opening of the internal compartment within the at least one vessel, each opening of the at least one opening of each internal compartment being at least partially and at least temporarily sealed by at least one enclosure element; and at least one internal ballistic protection element comprising at least one object that occupies and at least partially fills the internal compartment of the at least one vessel element for providing at minimum protection from shrapnel from indirect fire, the at least one vessel element receiving its respective internal protection element for assembly while the erecting frame system is in a relatively flat arrangement at the ground surface;

wherein at least one sidewall of the at least one vessel element performs a structural role of, and replaces, an A-frame leg of the at least two A-frame legs, the at least one connection and the at least one tensioning element of the erecting frame system being attached directly to the at least one vessel element and its respective containment system.

19. A shelter system comprising a) an erecting frame system comprising:

i) at least two A-frame legs, ii) at least one tensioning element, the A-frame legs each comprising: at least one elongated structural member, each of the A-frame legs coalescing with at least one other A-frame leg with at least one connection, the at least one tensioning element being at least temporarily affixed to a free end of each of the at least two A-frame legs, the at least one tensioning element comprising at least one substantially elongated structural element capable of generating a tension force to draw the free ends of the at least two A-frame legs towards one another, thereby at least temporarily lifting the at least one connection to a predetermined height above the free end of each A-frame leg;

iii) at least two additional A-frame legs with respective tensioning elements, and with a hinge type connection, at least temporarily affixed to the free end of each A-frame leg within a primary A-frame leg pair, the at least two additional A-frame legs serving to raise the shelter system off the ground surface by drawing free ends of each pair of two additional A-frame legs together with at least one of the tensioning elements; and b) a protective skin system comprising at least one planar element from a group of planes consisting of: a side plane, a roof plane, and an end plane, the side plane disposed between the two A-frame legs, the roof plane being concordant with a ground surface and of a similar elevation above the ground surface as the at least one connection point of the at least two A-frame legs, and the end plane disposed between the at least two A-frame legs of a constituent A-frame leg pair and the ground surface, the at least one planar element of the protective skin system providing at minimum protection from shrapnel from indirect fire to a volume behind the at least one planar element, the loading of the protective skin system being transferred at least in part first to the erecting frame system and ultimately to the ground surface.

20. A shelter system comprising a) an erecting frame system comprising:

i) at least two A-frame legs, ii) at least one tensioning element, the A-frame legs each comprising: at least one elongated structural member, each of the A-frame legs coalescing with at least one other A-frame leg with at least one connection, the at least one tensioning element being at least temporarily affixed to a free end of each of the at least two A-frame legs, the at least one tensioning element comprising at least one substantially elongated structural element capable of generating a tension force to draw the free ends of the at least two A-frame legs towards one another, thereby at least temporarily lifting the at least one connection to a predetermined height above the free end of each A-frame leg;

b) a protective skin system comprising at least one planar element from a group of planes consisting of: a side plane, a roof plane, and an end plane, the side plane disposed between the two A-frame legs, the roof plane being concordant with a ground surface and of a similar elevation above the ground surface as the at least one connection point of the at least two A-frame legs, and the end plane disposed between the at least two A-frame legs of a constituent A-frame leg pair and the ground surface, the at least one planar element of the protective skin system providing at minimum protection from shrapnel from indirect fire to a volume behind the at least one planar element, the loading of the protective skin system being transferred at least in part first to the erecting frame system and ultimately to the ground surface; and c) at least one wheel component at least temporarily fastened to the free end of at least one A-frame leg in order to reduce friction between the ground surface and the erecting frame system during a tensioning process; the at least one wheel component being at least temporarily affixed to the A-frame leg at such a height and angle so as to break contact with the ground surface as the A-frame legs are drawn together at completion of the tensioning process.

* * * * *